US005772795A

United States Patent [19]

Lally et al.

[11] Patent Number: 5,772,795

[45] Date of Patent: Jun. 30, 1998

[54] HIGH STRENGTH DEEP DRAWING STEEL DEVELOPED BY REACTION WITH AMMONIA

[75] Inventors: J. Scott Lally, Murrysville; Harish A. Holla, Monroeville, both of Pa.

[73] Assignee: USX Corporation, Pittsburgh, Pa.

[21] Appl. No.: 773,205

[22] Filed: Dec. 23, 1996

[51] Int. Cl.[6] ..... C23C 8/26; C21D 8/04; C21D 1/06

[52] U.S. Cl. ..... 148/221; 148/226; 148/228; 148/230; 148/318

[58] Field of Search ..... 148/211, 212, 148/216, 221, 226, 228, 230, 318

[56] References Cited

U.S. PATENT DOCUMENTS

| | | | |
|---|---|---|---|
| 3,399,085 | 8/1968 | Knechtel et al. . | |
| 3,847,682 | 11/1974 | Hook . | |
| 3,998,666 | 12/1976 | Cuddy et al. . | |
| 4,710,238 | 12/1987 | Dawes et al. | 148/320 |
| 4,846,899 | 7/1989 | Wilson . | |

FOREIGN PATENT DOCUMENTS

| | | | |
|---|---|---|---|
| 3502144 | 8/1985 | Germany | 148/212 |
| 404272143 | 9/1992 | Japan | 148/221 |

OTHER PUBLICATIONS

H. J. Grabke, "Kinetics of Phase Boundary Reactions Between Gases and Metals", Proceedings of AGARD (NATO) Conference on Reactions Between Gases and Solids, Oct. 1969, WPAFB, Dayton, Ohio.

M. Kitamura et al., "Efect of Carburizing aftrer Recystallization on Formability and Bake Hardenablity of Ultra Low Carbon Ti–Added Cold–Rolled Sheet Steels," Irong and Steel Research Laboratories, Kobe Steel, Ltd., Kakogawa, Japan, Int. Iron & Steel Jour., 1994, pp. 115–122.

*Primary Examiner*—Deborah Yee

*Attorney, Agent, or Firm*—Armstrong, Westerman, Hattori, McLeland & Naughton

[57] ABSTRACT

A method of producing high strength steel sheet and formed articles fabricated from the sheet and containing about 0.01–0.3 free and uncombined atomic percent Ti, Nb or V as strengthening element, by hot rolling or hot rolling plus cold rolling the sheet within limited temperature ranges, annealing the rolled sheet or formed articles at a temperature of about 1275°–1350° F. to provide a (111) grain structure, nitriding the annealed sheet or formed article in an annealing furnace at a temperature of about 800°–1250° F. under fully developed laminar gas flow, and controlling the strengthening of the steel article as a function of steel composition, the nitriding gas composition, nitriding time, nitriding temperature, thickness of the steel sheet and depth of strengthening desired, in accordance with specified relationships, to provide a steel article having an 0.2% off-set yield strength after temper rolling of at least about 40 ksi and an r value in excess of about 1.7 for the cold rolled sheet.

51 Claims, 20 Drawing Sheets

| Sample | SE/Int. |
|---|---|
| 8003 | 6.75 |
| 8004 | 8.07 |
| 8006 | 13.0 |
| 8007 | 8.13 |
| 8009 | 6.37 |
| 8010 | 4.26 |
| 8011 | 6.74 |
| 8012 | 5.36 |
| 8021 | 4.58 |
| 8022 | 8.19 |

| Sample | SE/Int. |
|---|---|
| 8003 | 6.75 |
| 8004 | 8.07 |
| 8006 | 13.0 |
| 8007 | 8.13 |
| 8009 | 6.37 |
| 8010 | 4.26 |
| 8011 | 6.74 |
| 8012 | 5.36 |
| 8021 | 4.58 |
| 8022 | 8.19 |

HIGH STRENGTH DEEP DRAWING STEEL DEVELOPED BY REACTION WITH AMMONIA

BACKGROUND OF THE INVENTION

1. Field of the Invention

This invention relates to a nitriding process that allows strength to be added to base steel sheet stock in a controlled and quantifiable manner irrespective of the previous thermomechanical processing applied to the base sheet. A particular aspect of the invention relates to the production of high strength steel sheet with high r (Lankford value, defining drawability, ie. resistance to thinning in a tensile test) and high n value (work hardening exponent measuring the slope of the stress vs. strain curve in the region of uniform plastic strain), by hot rolling or hot rolling and then cold rolling a DDQSK-FS (Deep Drawing Quality Special Killed-Fully Stabilized), type steel sheet to a minimum reduction in thickness, under restricted temperature conditions, annealing the cold rolled sheet, e.g. in an open coil annealing furnace (OCA), and then nitriding the steel sheet in such furnace with ammonia in a mixture with an inert or nearly inert gas such as nitrogen, argon or hydrogen, particularly nitrogen, hereafter called a buffer gas, and by controlling the steel strength in accordance with the amount of available strengthening element addition, the nitriding gas composition, the time and depth of nitriding, and the thickness of a steel sheet being nitrided. Hot rolled sheet may also be similarity nitrided. The sheet also may be formed into an article before nitriding to develop strength.

2. Description of the Prior Art

U.S. Pat. No. 3,399,085, issued in 1965 to Knechtel and Podgurski, disclosed the nitriding of a relatively high carbon nitriding steel, such as "Nitralloy 135M" (0.38–0.45% C), by treatment of the steel with a mixture of ammonia and hydrogen having a nitrogen activity of about 0.5 to 1.8 to a diamond pyramid hardness (DPH) of at least 1000, and a depth of at least 16 mils.

In a paper, "Kinetics of Phase Boundary Reactions Between Gases and Metals," published by H. J. Grabike in Proceedings of AGARD (NATO) Conference on Reactions Between Gases and Solids, October (1969) WPAFB, Dayton, Ohio, it was shown that the role of "buffer" gases (hydrogen in this case), when present with ammonia in nitriding gas mixtures, is to retard the kinetics of catalytic decomposition of ammonia in the presence of iron. This characteristic of these buffer gases, and the reason for employing this term, is to slow decomposition and keep the nitrogen activity of the nitriding mixture more nearly constant, ie. buffered, from the nitriding gas entrance to the exhaust in the nitriding furnace.

U.S. Pat. No. 3,847,682, issued in 1974 to Hook, disclosed strengthening deep drawing steel sheet containing about 0.002–0.015% C, up to about 0.012% N, up to about 0.08% Al, and an available nitride forming strengthening element such as 0.02–0.2% Ti, 0.025–0.3% each of Nb and Zr, by nitriding the sheet in ammonia and, hydrogen, at a temperature between 1100° F. and 1350° F., to form nitrides to provide a yield strength of at least 60 ksi.

The method of controlling nitriding as disclosed in U.S. Pat. No. 3,399,085 was referred to in U.S. Pat. No. 3,998,666, issued in 1976 to Cuddy and Podgurski, which disclosed the strengthening of low (0.001–0.02%) carbon steels containing 0.05–0.5% strong nitride forming elements of group IVB and VB by nitriding the steel in an atmosphere having a nitrogen activity sufficient to effect the diffusion of nitrogen into the steel but below the nitrogen activity which will form iron nitride. According to the Cuddy el al. patent, the preferred range of nitrogen activities for the nitriding gas activities is 0.16 to 0.22 which corresponds to roughly 12 to 17 percent ammonia/hydrogen mixtures. Sheet so treated was cold rolled up to 40% reduction in thickness and annealed at various temperatures prior to nitriding. Hot rolling practice is not specified.

The ammonia/hydrogen mixtures, as used by Knechtel et al., Hook and Cuddy et al., are explosive and hence can be dangerous for commercial use in enclosed steel processing plant surroundings. Moreover, the high ammonia content of the nitriding gas compositions of Knechtel et al. and Cuddy et al. would result in excessive surface nitrogen levels and possible Fe4N precipitation in the nitrided steels under the fully developed laminar gas flow conditions used in the present invention.

More recently, low carbon "interstitial free" steels have been strengthened by a process of oxinitrocarburization, a two step process in which such steel, microalloyed with titanium or niobium, is first subjected to nitrocarburizing, a thermochemical diffusion treatment in which the steel surface is enriched with nitrogen and carbon to form a compound layer of iron carbonitride, and then the steel is oxidized to form an iron oxide layer on top of the compound layer. "Strengthening of Microalloyed Sheet Steel by Oxinitrocarburizing (Nitrocarburizing with Post Oxidation)," H. S. Blaauiw and J. Post, *Heat Treatment of Metals,* 1996.3, pages 53–56.

We have found that the nitrogen activity of the gas, which is the controlling factor in the Cuddy et al. patent, while important, is less so than the activity of nitrogen in an adsorbed layer on the steel surface which determines the surface nitrogen composition of 1 steel being nitrided. This latter activity, or "nitriding potential," is affected by many factors other than nitriding gas composition, such as films, e.g. oxides, or poisons, e.g. carbon, on the surface of the metal being nitrided, and the rate and nature of gas flow. The term "nitriding potential" may be used to designate the measure of the ability to introduce nitrogen into steel as affected by both nitriding gas composition and the type of boundary layer flow in contact with the steel surface and is approximately given by the ratio of the partial pressure of adsorbed ammonia to that of all other relatively inactive adsorbed buffer gases on the steel surface. We also have found that the effect of fully developed laminar gas flow (compared to transition to laminar flow at the entrance gap) in the open coil annealing furnace can increase the nitriding potential by a factor as large as two. For simplicity, the flow at the entrance gap to a coil of sheet steel is referred to herein as "transition flow."

The prior art does not mention a degassing processing step to reduce carbon interstitials, followed by deoxidizing, prior to adding the strength-forming elements titanium, niobium and vanadium. This is an essential step in controlling strength.

Strength development in conventional high strength sheet is due to precipitate formation (coherent and incoherent), dislocation accumulation and grain refinement during hot rolling. The steel compositions employed and the processing used to develop strength usually results in low r value sheet. The processing proposed here separates the dislocation networks, grain size and texture development phase of processing from the strength development. Therefore the sheet processing prior to nitriding can be chosen to produce a strong (111) texture which is desirable for drawability (and generally unavailable by traditional methods) or any other microstructural or textural features desired in the final product.

SUMMARY OF THE INVENTION

In accordance with the present invention, we provide DDQSK-FS type steels, which were not generally commercially available at the time of most of the prior art discussed above, consisting essentially, by weight percent, about 0.001–0.02% C, 0.05–0.50% Mn, 0.005–0.08% Si, 0.02–0.06% Al, 0.002–0.02% S, 0.001–0.01% N, 0.0005–0.01% O, with residual amounts of P, Cu, Ni, Cr, No and a strengthening element in total available amount of from about 0.01–0.3 atomic percent free and uncombined with other elements and selected from the group consisting of Ti, Nb and V and mixtures thereof, particularly Ti and mixtures of Ti with minor amounts of Nb and/or V effective to provide strengthening, within the aforesaid range, added after degassing for carbon removal and deoxidation; either (a) hot rolling the steel slab to a bar between 2350° F. and 1750° F., followed by finish rolling with a ferrite structure, toward the high end of a temperature range of about 1200°–1675° F. and finishing toward the low end of this range, and coiling below 1250° F., or (b) when the finished product will be cold rolled, hot rolling, with an austenite structure in the temperature range 2350° F. to 1500° F., preferably between 2200° F. and 1650° F. An alternative finish rolling would be to roll in ferrite starting at 1675° F. and finishing above 1375° F. with coiling temperature not less than 1350° F., followed by cold rolling of the sheet to a reduction in thickness of at least about 60%. The rolled sheet then is coiled, annealed at a temperature of about 1250°–1400° F., preferably about 1275°–1350° F., for example for about 2 hours, to optimize the formation of a (111) grain structure, and then treated in an open coil annealing furnace, in an isothermal step at a temperature of about 800° F. to 1250° F., preferably 950° F. to about 1150° F., with a nitriding gas delivered to the open coil annealing furnace and consisting of a mixture of from about 3, preferably about 7 or 8, volume percent to about 12 volume percent ammonia in a buffer gas such as nitrogen, argon or hydrogen, preferably, nitrogen or argon, and especially, nitrogen, and for a time from about ½ hour to about 12 hours depending on the sheet thickness and the desired depth of strengthening, to nitride the steel sheet through at least a portion of the sheet thickness. The nitriding gas is recirculated through open coil wraps at a rate and in a manner to provide for fully developed laminar flow across the width of the steel sheet, and strengthening of the steel sheet is controlled as a function of steel and nitriding gas compositions, nitriding time and temperature, thickness of the steel sheet and depth of strengthening desired to provide a steel sheet having an 0.2% off-set yield strength after temper rolling of at least about 40 ksi (or a lower yield stress of similar magnitude in the as nitrided condition) and an r value in excess of about 1.7. The flow rate of fresh nitriding gas mixture into the recirculation flow under the inner cover of the open coil annealing furnace must be such as to provide sufficient nitrogen for the weight of the coil(s) being nitrided. In general, the total nitrogen pickup by the steel should be limited to about 0.04% by weight to minimize problems with weldability and strain aging.

The processing of the base sheet stock prior to nitriding described above will provide a drawable high strength sheet. However the nitriding process can also be used on sheet of similar composition that has been processed differently prior to nitriding. For applications where high r values are not required, different cold rolling and annealing practices, such as normalizing, may be employed. Similarily, hot rolled stock could be finished in austenite before nitriding.

A pickling and cleaning step is required after hot rolling when nitriding cold rolled sheet. However, when nitriding hot rolled material it is not necessary to remove the scale from the hot rolling operation. Neither is it necessary to recrystallize hot rolled sheet finished in austenite. Any protective material placed on the sheet after final rolling must be removable on heating in the OCA without leaving a deposit on the surface.

The nitriding process described herein employs the mechanism of internal nitriding or subscale nitride formation to develop strength in the appropriate base steel stock. Internal nitriding implies that $Fe_4N$ formation is suppressed by employing nitriding potentials below that required for iron nitride development during nitriding or during cooling after nitriding. The nitriding potentials used and the temperature of nitriding must satisfy commercial requirements that strength is uniform everywhere on the sheet and that the nitriding times employed are not either too long as to be excessively costly or too short to supply the necessary nitrogen to the steel if there are gas delivery flow constraints. The hardening progresses inward from the surface in the form of a front with nearly uniform high hardness behind the front and base sheet hardness in advance of the front. Nitriding depth as used herein is the position of the internal nitride front relative to the sheet surface. Strength can be controlled by nitriding in a controlled manner to less than full depth. Aging is also available for secondary strength control.

The technology described here offers opportunities to use low interstitial steels made in degassers which are now commonly available. These steels provide a body centered cubic iron lattice with minor alloy additions in which strengthening precipitates can be built up in a controlled way to tailor the properties to the end use. This methodology has the potential to supercede older methods of developing strength that rely on supersaturation of solute on cooling to form precipitates which are hard to control and are usually larger and incoherent with the ferrite matrix and therefore less potent strengtheners. Because the steels of this invention are strengthened by small coherent disk precipitates, the strength can be predicted by simple expressions instead of the complicated models required to predict strength using traditional methodologies. The term coherent when applied to the monolayer nitrides formed in this invention refers to the close matching of the plane of the precipitate to the ferrite matrix and permits a small misfit dislocation around the perimeter. There is some evidence that the nitrides may thicken to two layers before the onset of averaging but it is assumed, for simplicity, that monolayer nitrides are formed.

BRIEF DESCRIPTION OF THE DRAWINGS

FIGS. 3(*b*) and 3(*c*) show typical lower yield stress variation versus atomic percent free strengthening element after fully nitriding samples of 0.024 and 0.030 mil thickness at different temperatures. Higher strength is developed when an identical base steel of the same thickness is fully nitrided at higher temperatures in the temperature range shown in the figures;

DESCRIPTION OF PREFERRED EMBODIMENTS

In its broadest form, the object of this invention is use of a nitriding treatment to develop strength in a controlled manner in the final processing stage of DDQSK-FS type steel sheet production. After the casting phase of production, any microstructure or grain orientation texture can be developed in the sheet by hot rolling, cold rolling, thermal cycling or annealing treatments. More particularly, an object of this invention is to produce high strength internally nitrided steels having 1) a high work hardening exponent (n value), 2) a high resistance to thinning and tearing on drawing (high r value), and 3) a high modulus of elasticity (Young's Modulus) in the plane of the sheet. A strong (111) texture develops in this steel sheet during annealing prior to nitriding and provides an elastic modulus in the plane of the sheet higher than for isotropic steel sheet. This anisotropy of the elastic constant can be employed to make stiffer structures—an important factor, for example in auto body construction. High strength primarily is achieved through steel chemistry (the amount of free, uncombined Ti, Nb and/or V, forming strengthening precipitated nitrides on nitriding). Full strength, in this context, is developed when internal nitriding fronts from both surfaces meet at the sheet centerline.

Figure 1:
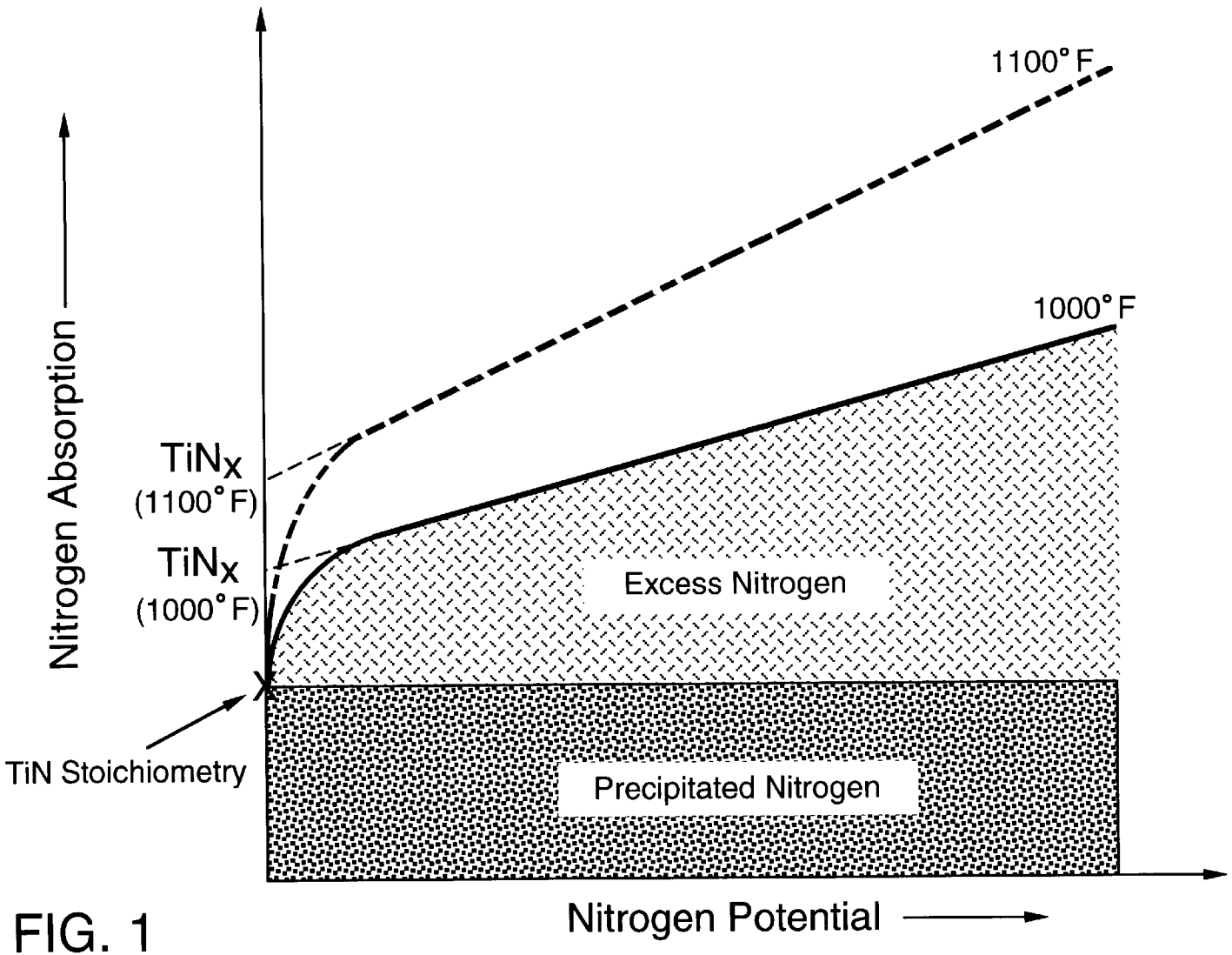
FIG. 1 is a graph showing a schematic of two nitrogen absorption isotherms.

Prior art sheet nitriding processes have not been successful in providing uniform strength properties throughout the width of the sheet. We have found that uniformity of properties is promoted by nitriding a sheet coil in an open coil annealing furnace wherein the nitriding gas flow is fully developed laminar flow everywhere between the wraps, nitriding at moderately low temperatures where the nitrogen absorption isotherm has a relatively shallow slope, and by working in a region of nitrogen potential where the absorption isotherm is linear. The nitrogen absorption isotherm is shown schematically in FIG. 1. This representation of nitrogen absorption versus nitriding potential is very near the sheet surface exposed to the nitriding gases where bulk diffusion does not affect the response. The schematic shows that nitrogen absorption is composed of two parts; (a) precipitated nitrogen in the form of coherent monolayer titanium (or other strengthening elements) nitride precipitates on (100) planes of ferrite and (b) excess nitrogen that is disolved in ferrite or is either trapped in the strain fields of the precipitates or at precipitate interfaces. It is clear from the isotherm schematic that low nitriding temperatures promote lower excess nitrogen pickup and lower sensitivity of nitrogen absorption to fluctuations in nitriding potential.

The DDQSK-FS base steels of the invention can be processed by either hot rolling in the ferrite region, or by hot rolling in the austenite region followed by cold rolling, and annealing, to provide a steel of (111) preferred grain orientation with high r values, e.g. at least about 1.7. When nitrided under the conditions of the invention, such steels have high strength, at least about 40 ksi, uniform across the sheet width, and with high r and n values. Because the strengthening nitride precipitates coarsen by a very slow process (Ostwald ripening), a very stable microstructure/strength producing system is produced, resulting in superior high temperature strength in the ferrite phase field for the nitrided steel sheet of this invention.

Figure 2:
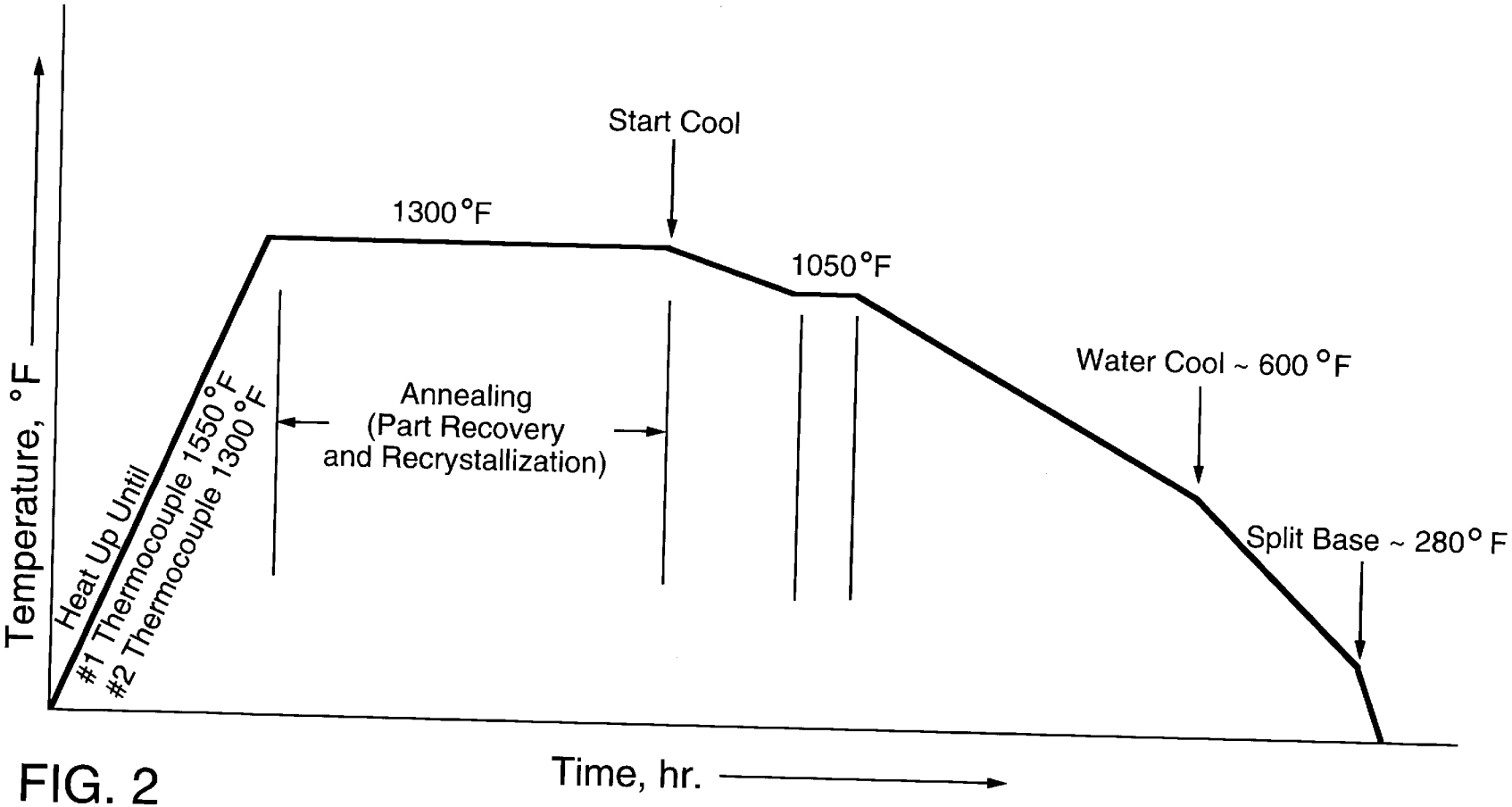
FIG. 2 is a graph showing a typical commercial open coil anneal and nitriding cycle in accordance with the invention.

FIG. 2 shows a typical annealing and nitriding cycle of the invention. A coil of DDQSK-FS steel sheet is placed on the base of an open coil annealing furnace, the cover placed over the coil on the base, and, as shown in FIG. 2, the coil is heated to an annealing temperature of 1300° F., held at that temperature for a time sufficient to optimize the (111) grain structure, and then cooling is commenced wherein the temperature is lowered to 1050° F. and held at this constant temperature nitriding shelf while nitriding is carried out. The nitrided steel coil then is cooled to 600° F., then water cooled to 280° F. at which temperature the cover of the annealing furnace is removed and the coil allowed to cool to ambient temperature. The temperatures shown in FIG. 2 are specific, preferred temperatures and it is to be understood that the respective temperatures can be any temperature within the respective ranges above specified.

In order to further strengthen steel sheet which has been fully nitrided, i.e. the internal nitriding fronts from both surfaces meet in the sheet center, in accordance with the above-described processing, there may be included in the processing cycle a further treatment of the nitrided sheet in a second isothermal annealing shelf at a temperature higher than the nitriding temperature but less than 1300° F. to increase the strength of a fully nitrided sheet which exhibits less than the aim strength. In such second annealing treatment, the furnace atmosphere may be reducing to nitrogen, neutral or weakly nitriding, depending on the properties desired.

We have discovered that the fully nitrided strength of a steel sheet of a given thickness is proportional to the square root of the volume fraction of precipitates, which also is proportional to the square root of the atomic weight percent of the free Ti, Nb and V at the nitriding temperature.

Figure 3A:
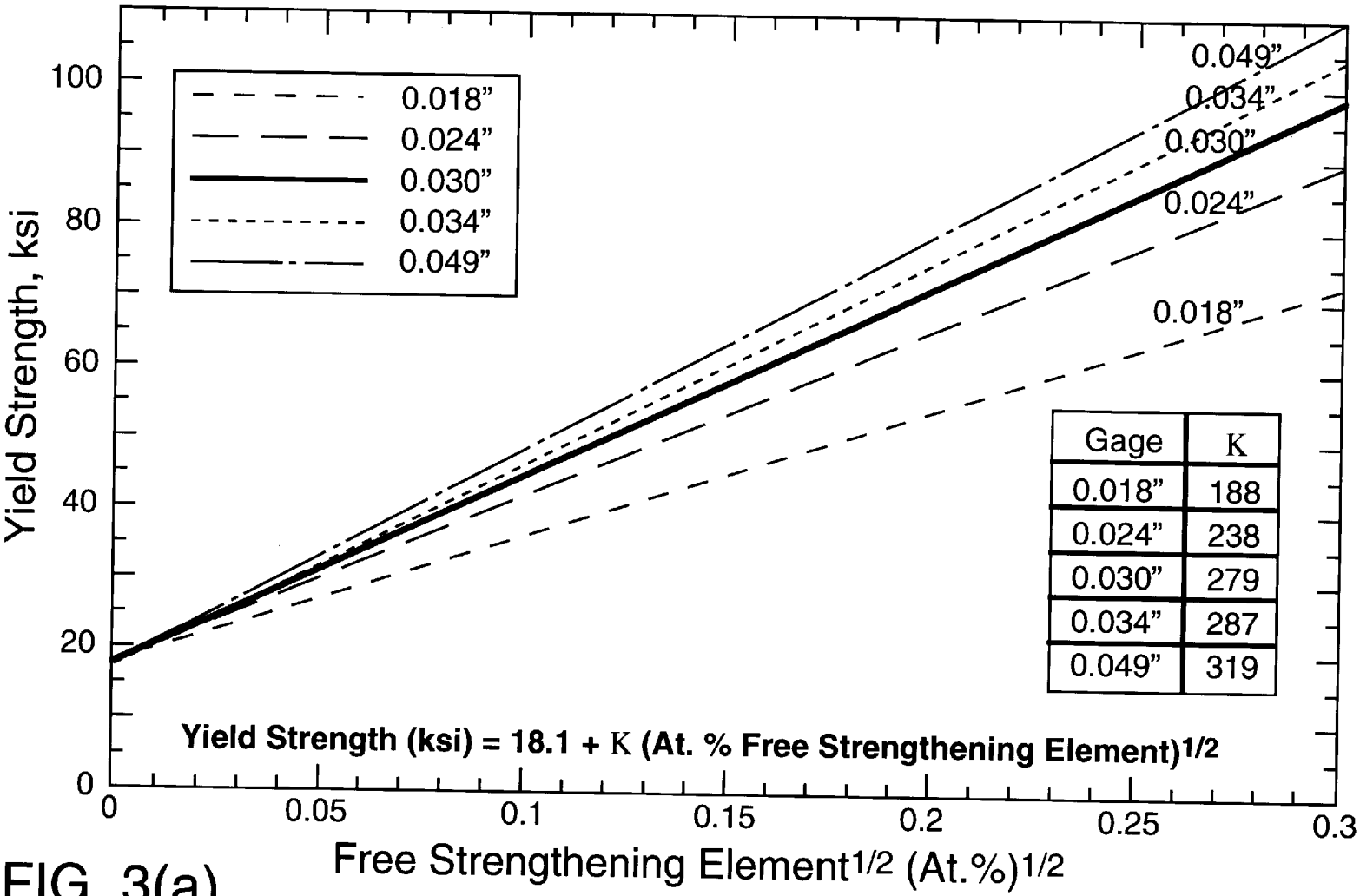
FIG. 3(*a*) is a graph relating yield strength and the amount of effective or available free strengthening element for five different sheet thicknesses, including laboratory and plant data using a nitriding temperature of 1050° F.
Figure 3B:
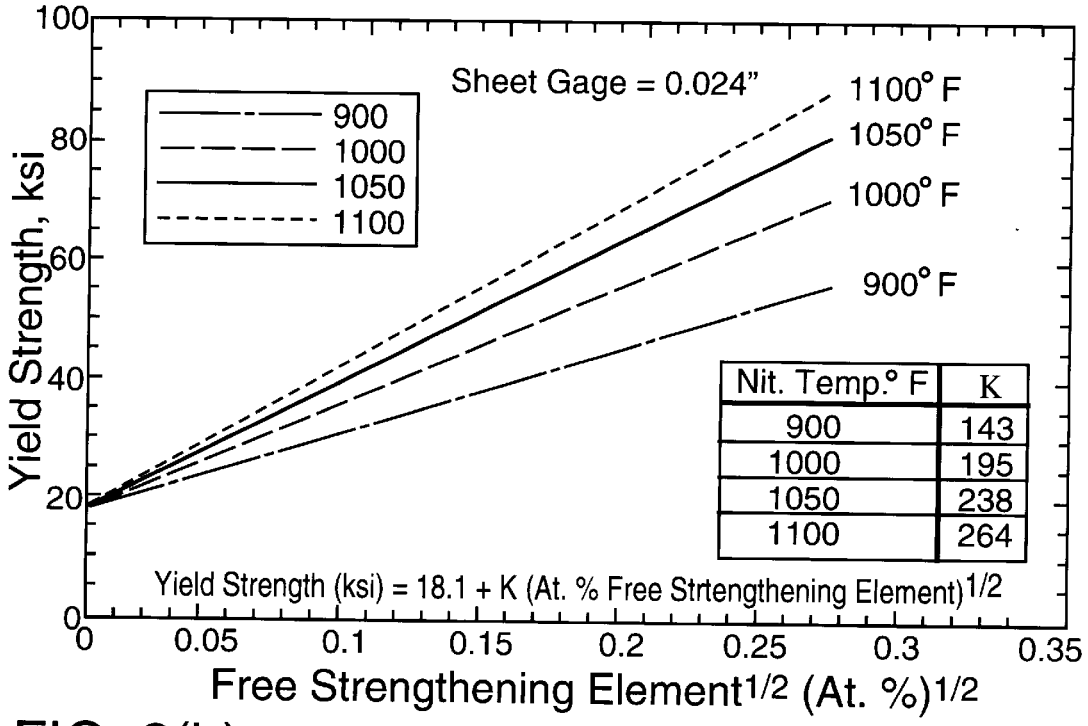
Figure 3C:
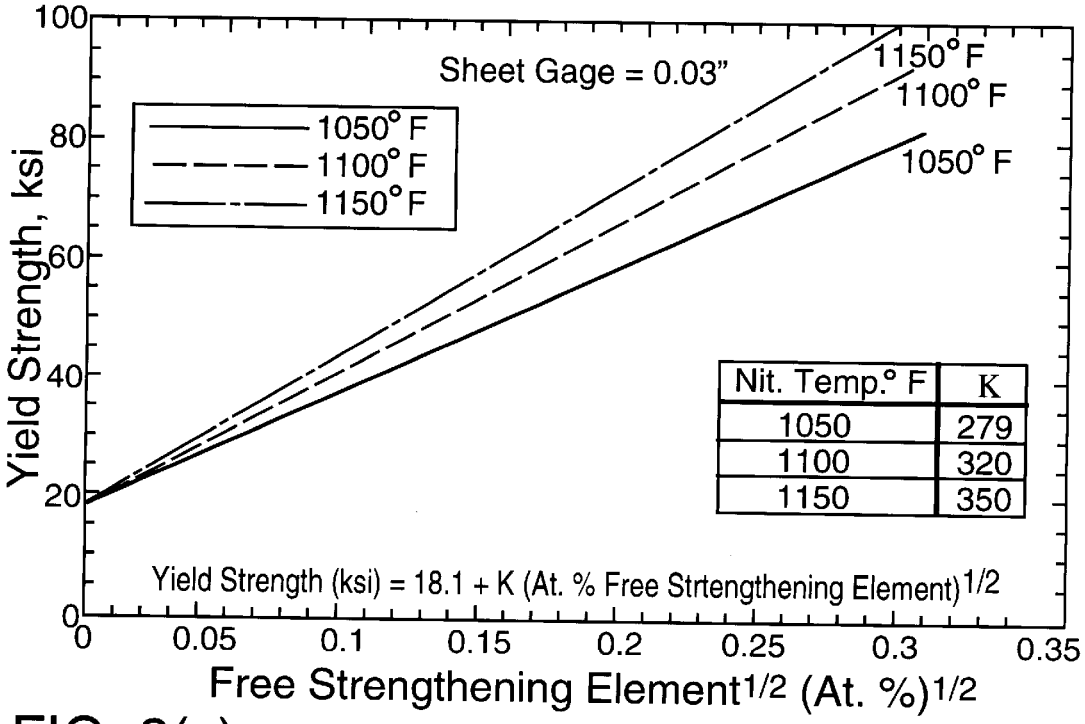

This relationship is shown by the family of curves in FIGS. 3(*a*)–(*c*) and by the following equation:

$$\sigma_Y=18.1+KF_M^{1/2} \quad \text{(Equation 1)}$$

where $\sigma_Y$ is yield strength and $F_M$ is the effective amount, atomic percent, of strengthening element Ti, Nb and/or V in free form available for forming nitrides on nitriding. The parameter K is determined experimentally and is both thickness and nitriding temperature dependent. For example, for a nitriding temperature of 1050° F., using 10% ammonia/nitrogen mixtures in a labaratory tube furnace, K is determined for a range of sheet thicknesses as follows:

(a) K=188 for sheet 18 mils thick (b) K=279 for sheet 30 mils thick (c) K=299 for sheet 34 mils thick (d) K=319 for sheet 49 mils thick This discovery enhances the ability to control accurately the strength of fully nitrided sheet and provides a primary strengthening control mechanism. The parameter $K=K(T_S, C_N, T)$ is dependent on the variables $T_S$, sheet thickness, $C_N$, surface nitrogen concentration and, most particularly, on the nitriding temperature, T. These variables, and $F_M$, the amount of free strengthening element present, can be used to control fully nitrided yield strength.

In FIGS. 3(*a*)–(*c*), the amount of free or available strengthening metal in the DDQSK-FS base steel sheet, that is the amount of strengthening metal in solid solution uncombined with other elements, is related to yield strength of the steel after nitriding at 1050° F. From those figures, it is seen that yield strength is proportional to the square root of atomic percent of the uncombined metallic strengthening element in the base sheet, in accordance with Equation 1 (a), (b) (c) and (d) above. Different parabolic strengthening relationships are required for each thickness of sheet and for each nitriding temperature employed because nitriding front mean velocities differ and the strengthening precipitates age by different amounts resulting in yield stress changes. This relationship provides the great advantage, over prior art knowledge, of being able to accurately control starting chemistry of the steel to obtain a particular desired maximum strength after nitriding. When titanium and niobium are employed as the strengthening elements it may be assumed that all the carbon and nitrogen are totally bound to these strengtheners in 1 to 1 stoichiometry at the nitriding temperatures before nitriding takes place. However the high solubility product of vanadium carbide precludes such a simple calculation when using vanadium as a strengthener. The release of free vanadium from the dissolution of vanadium carbide produced during previous hot rolling results in substantially more strength increase than the 1 to 1 stoichiometry estimate gives.

A data set of fully nitrided yield strength vs. square root atomic percent strengthening element must be obtained for each nitriding temperature. In general, as the nitriding temperature is raised, the fully nitrided yield strength per unit addition of strengthener increases. The variation of the parameter K relating $sigma_Y$ to $F_M$ can be determined as a function of temperature for different sheet thicknesses. These results can then be used as a primary means of strength control if the actual heat chemistry misses the aim chemistry. In practice, the aim heat chemistry should be determined for the sheet thickness to be manufactured assuming that an intermediate nitriding temperature will be used. If the actual heat chemistry is rich in $F_M$, then lower nitriding temperatures can be used to achieve the same aim yield strength level. Obviously, higher nitriding temperatures will be used if the chemistry turns out to be lean. Some examples of K=KT for sheet of different thicknesses over a range of temperatures within those specified in the invention are given below and in FIGS. 3(*b*) and 3(*c*).

For sheet 0.024 inch thick:

(a) $K_{900}$=143 for fully nitrided sheet at 900° F.

(b) $K_{1000}$=198 for fully nitrided sheet at 1000° F.

(c) $K_{1050}$=238 for fully nitrided sheet at 1050° F.

(d) $K_{1100}$=259 for fully nitrided sheet at 1100° F.

For sheet 0.030 inch thick:

(a) $K_{1050}$=279 for fully nitrided sheet at 1050° F.

(b) $K_{1100}$=320 for fully nitrided sheet at 1100° F.

(c) $K_{1150}$=352 for fully nitrided sheet at 1150° F.

Figure 4:
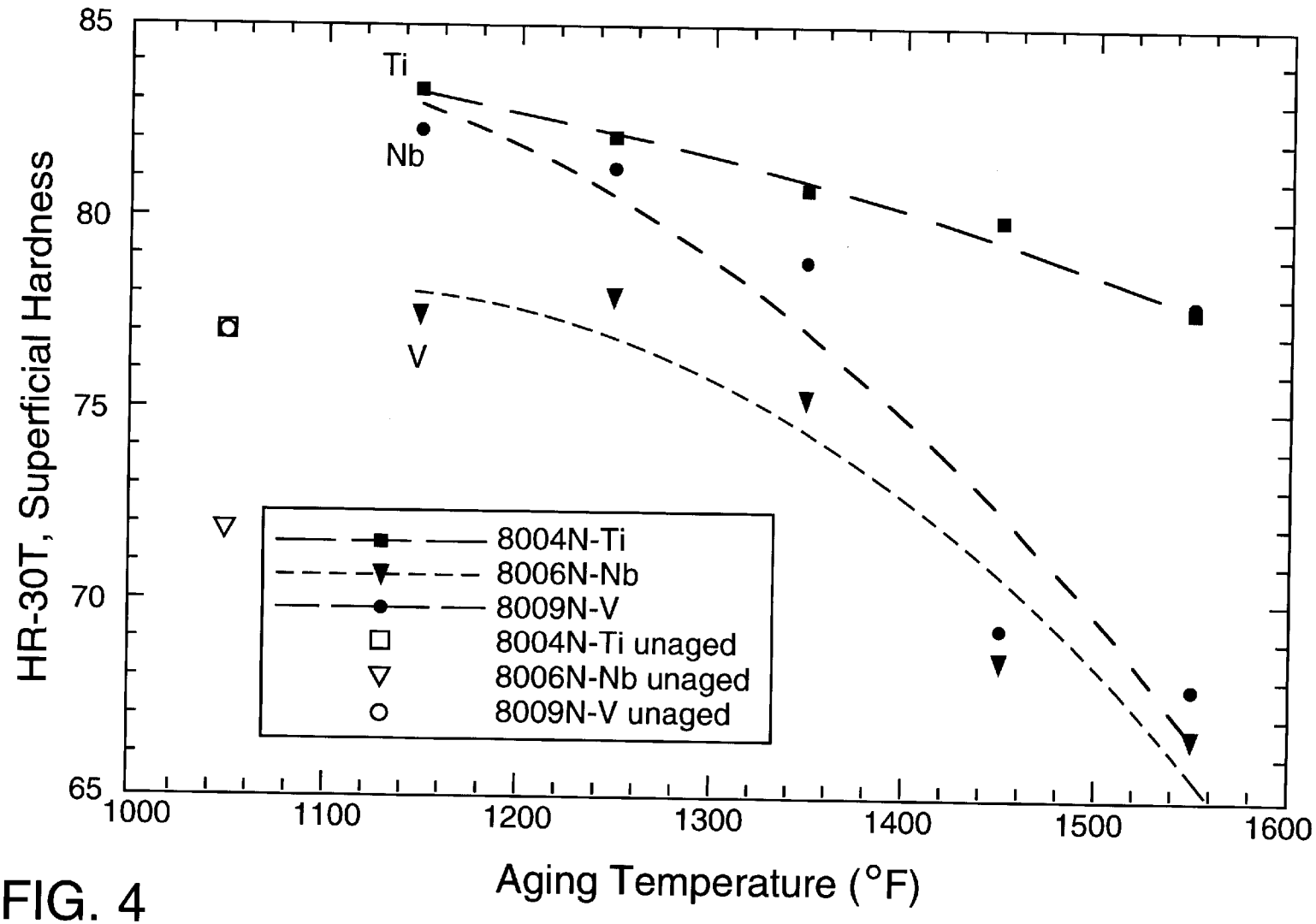
FIG. 4 is a graph of the postnitriding hardness aging response of laboratory nitrided and aged sheet strengthened with Ti,Nb or V, at a nitriding temperature of 1050° F., and wherein total nitrogen in the sheet was about 0.04 wt %.

At very high temperatures, substantially over 1150° F., averaging and softening set in (see FIG. 4).

The yield stress parabolic relationship with the free strengthening elements shown experimentally in FIGS. 3(*a*)–(*c*) is readily explicable using simple considerations. The flow stress may be written as the sum of component terms;

$$\sigma=\sigma_P+\sigma_{COH}+\sigma_{CUT}+\sigma_{dISL}+\sigma_{GS}$$

where $\sigma$ is the yield stress;

$\sigma_P$ is the Peierls or friction stress;

$\sigma_{COH}$ is the coherency stress component;

$\sigma_{CUT}$ is the precipitate cutting term;

$\sigma_{Dial}$ $\sigma_{GS}$, the dislocation and grain boundary terms, may be neglected when considering the yield point in these steels.

The friction stress is a constant. For thin disk type precipitates of the kind formed by this invention, both the coherency and the cutting component are proportional to the square root of the volume fraction of precipitates, and therefore must also be proportional to the square root of the atomic weight percent of free strengthening element that forms these precipitates. The experimental results of FIGS. 3(*a*)–(*c*) are in accordance with these simple parameters. The effects of the coherency and cutting terms can be separated because the coherency term is proportional to the square root of the inverse precipitate radius whereas the cutting term is proportional to the square root of the radius. As the disk precipitates grow, eventually the cutting term predominates and the yield stress increases with the square root of the precipitate disk radius. The aging results that follow are easily understandable in terms of the foregoing description.

For fully nitrided sheet the yield strength versus the free available strengthening element relation shown in FIGS.

Figure 8:
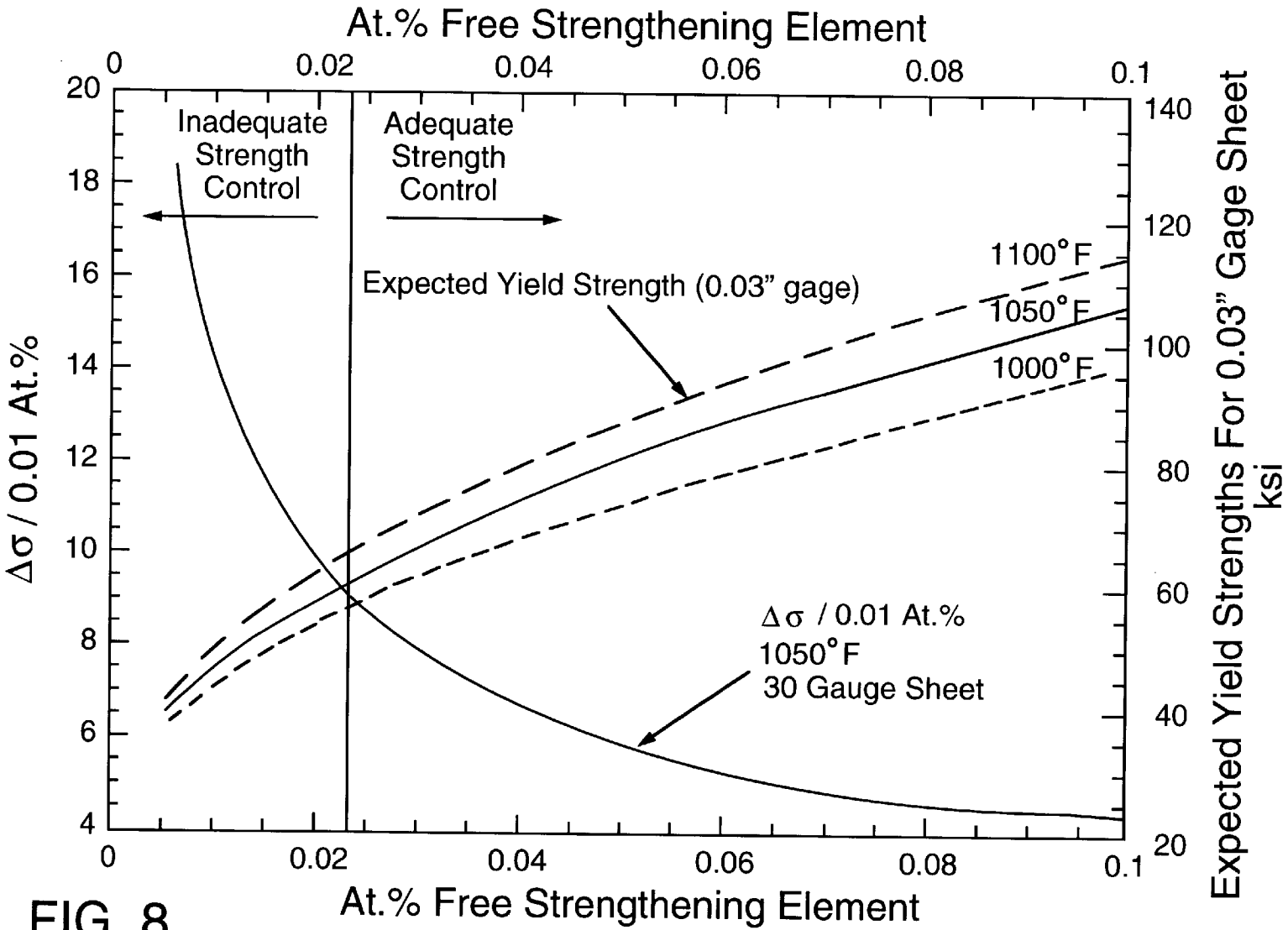
FIG. 8 is a graph of the sensitivity of yield stress increase to incremental change in the amount of free strengthening element available, and to changes in the nitriding shelf temperature employed.

3(*a*)–(*c*) and Equation 2 can be expressed in a different form, as in FIG. 8, comparing the incremental yield change due to both strengthening element change and nitriding shelf temperature change near 1050° F. As shown in this latter figure, the incremental change in stress due to 0.01 atomic weight percent change in strengthening element diminishes with increasing strengthener. The effective change in incremental strength for a plus or minus 50° F. change in the nitriding shelf temperature increases with increasing amount of strengthener. As shown in FIG. 8 at about the 60 ksi yield stress level and higher, for 30 mil thick sheet, the 100° F. nitriding temperature change can correct for a chemistry miss of 0.01 atomic weight percent in strengthening element. This suggests that there is adequate process control available to meet an aim yield stress in a commercial situation over a large range of yield stress targets. With larger variations in the nitriding shelf temperature and tighter chemistry control, even lower strength sheet can be made commercially.

The autoaging that occurs during normal isothermal nitriding can best be understood by performing separate postnitriding aging experiments. FIG. 4 shows the hardness response on aging of three sheet steels using titanium, niobium and vanadium as the strengthening element after nitriding at 1050° F. All three steels show an increase in hardness on aging at 1150° F. followed by averaging and softening at higher temperatures. The aging response follows the solubility product differences for these steel with titanium being the most resistant to overaging and vanadium the least. The steels shown in this figure had nitrogen levels of the order of 0.05 wt. %. Steels with lower levels of nitrogen show a weaker aging response. The aging response of fully nitrided sheet is affected slightly by the nitriding or reducing properties of the gas in contact with the sheet. This aging behavior can be used as a method of modifying strength after nitriding by modifying the OCA cycle to include a post nitriding aging shelf. Raising the nitriding shelf temperature from 1050° F. to 1150° F. also can produce a strength increase similar to the aging response and can be used as a method of strength control.

Figure 5:
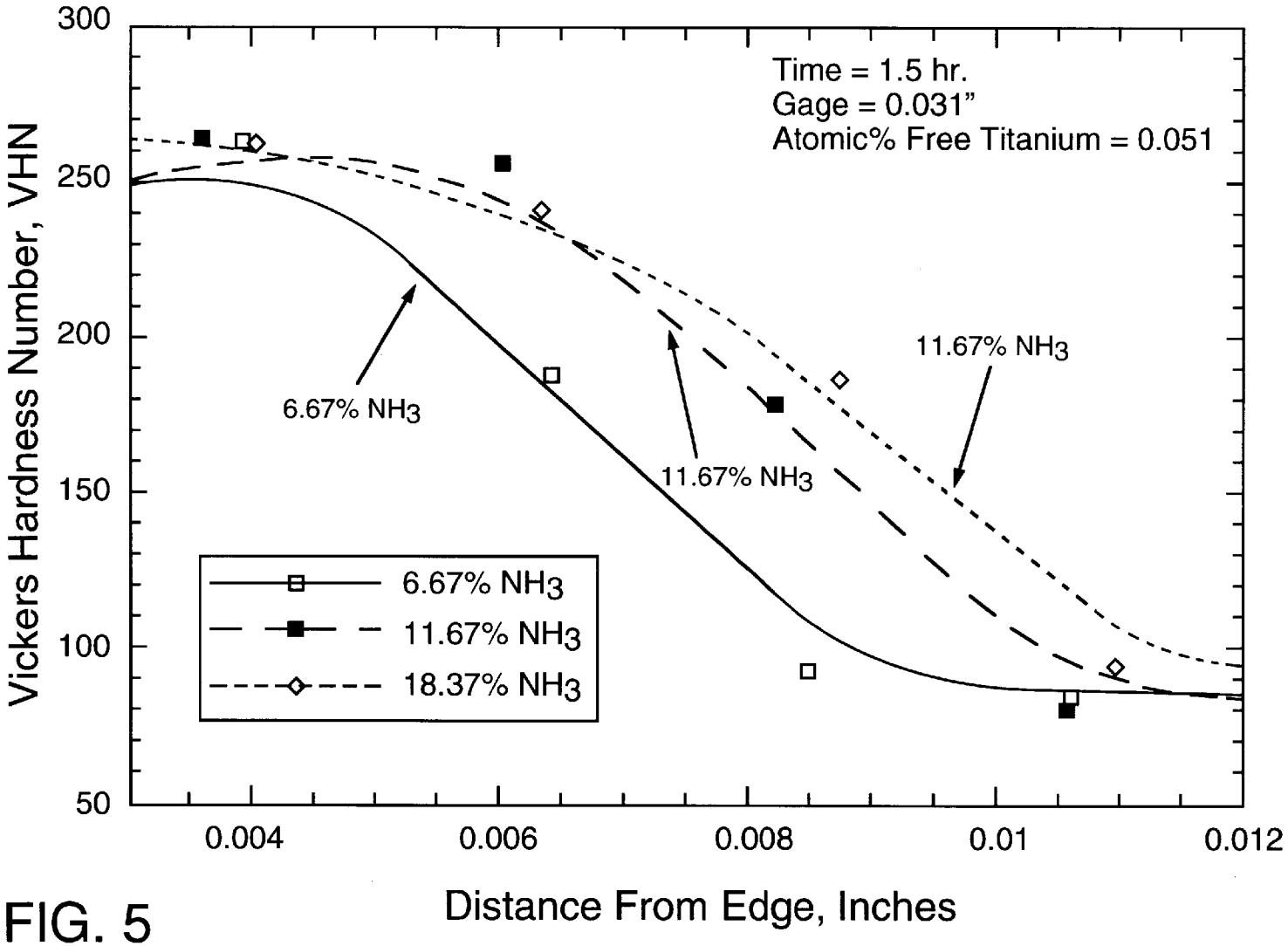
FIG. 5 is a graph showing hardness profiles obtained by charging at three different nitriding potentials under laboratory flow conditions at the same temperature in the same base sheet.
Figure 6:
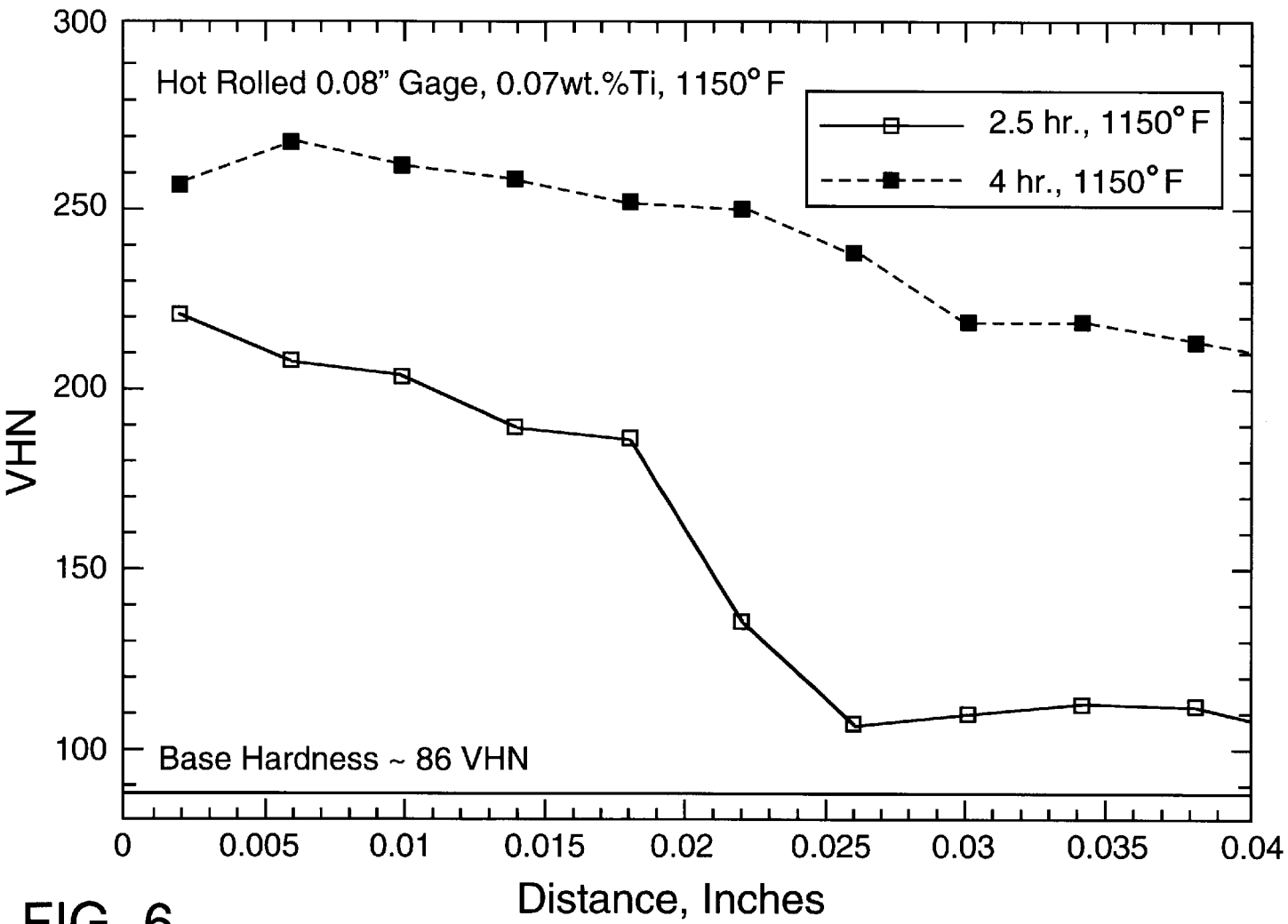
FIG. 6 is a graph showing different hardness profiles obtained by nitriding in laboratory flow conditions the same hot rolled base sheet under the same gas and temperature conditions for two different times.

Some understanding of the processes involved during internal nitriding can be gained by examining the response of the steel sheet by microhardness traverses through the sheet crossection after nitriding. In FIGS. 5 and 6 are the nitriding depth profiles determined by hardness measurements for isothermal nitriding for the same time at different nitriding potentials (FIG. 5) and for nitriding using the same nitriding potential using time of nitriding as the variable (FIG. 6). In FIG. 6 two different nitriding times have been employed on the same hot rolled base sheet. Several features should be noted in this figure. (A) the nitriding front has penetrated more deeply after 4 hours than after 2.5 hours nitriding; (B) the hardness shelf is higher for the long nitriding time sample indicating aging behind the front (the slope of the hardness shelf behind the front is also an indication of aging), and (C) there is considerable nitrogen leakage and hardness increase ahead of the internal nitriding front in this sample. The hot rolled base sheet was not annealed prior to nitriding and dislocation pipe diffusion through the front is the likely cause of nitrogen leakage and resulting hardening ahead of the front. Typically, in annealed cold rolled sheet, there is little hardening ahead of the front, as depicted in FIG. 5.

Figure 7:
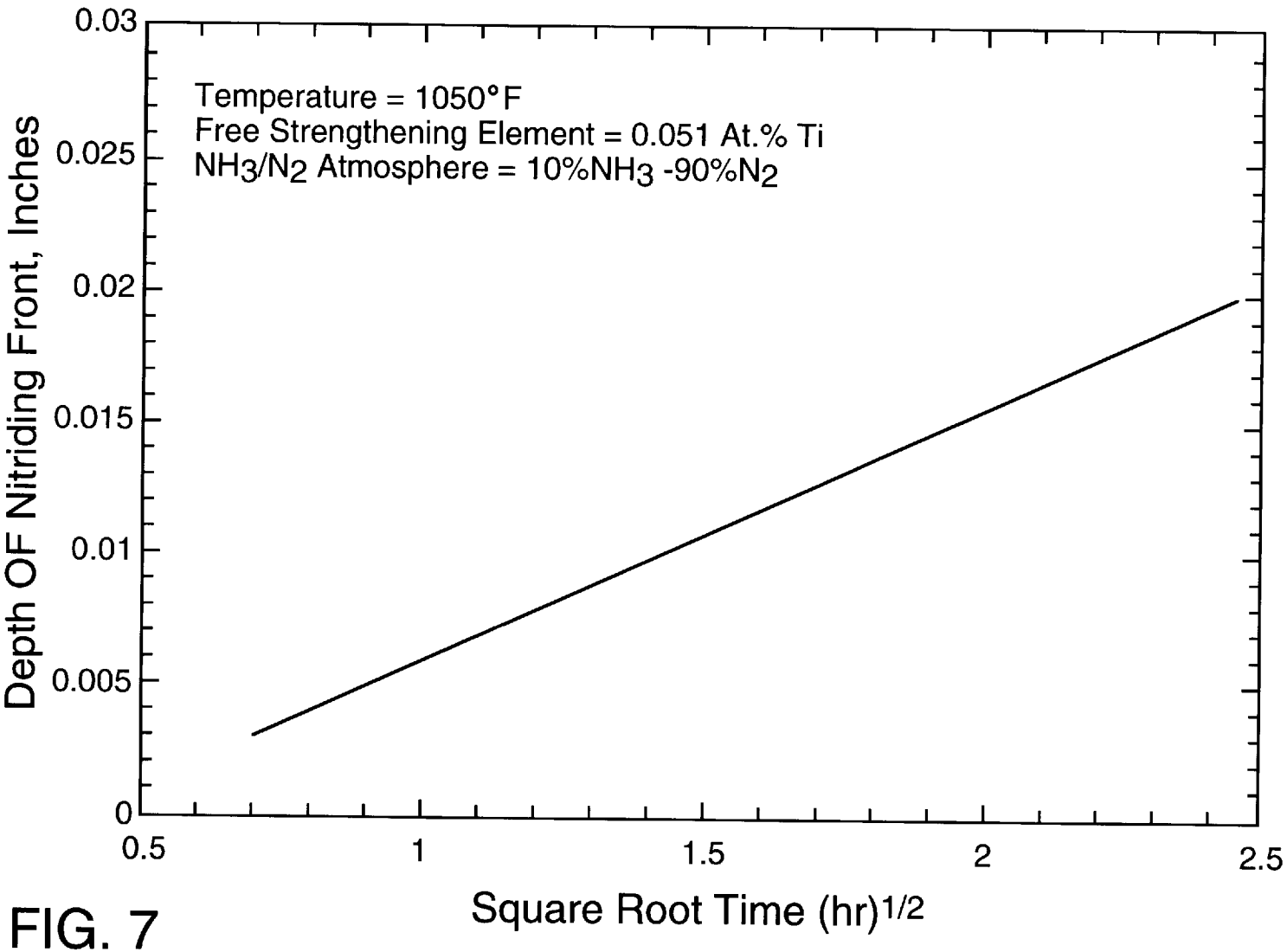
FIG. 7 is a graph relating depth of nitriding and nitriding time at a particular level of free titanium for ammonia/nitrogen nitriding gases in fully developed laminar flow conditions.

Depth of hardening, at the nitriding temperature, is controlled by the rate of nitrogen diffusion through the steel and, to a lesser degree, by the nitriding potential and the free titanium (or other strengthener) content of the steel. The effect of varying the nitriding potential on the depth of nitriding is shown in the hardness depth profiles shown in FIG. 5. The hardness depth relationship is expressed in graphical form in FIG. 7 and in equation form below:

$$\text{Depth of Nitriding} = \frac{[\alpha C_N D_N t]^{1/2}}{\sqrt{F_M''}} = \beta\sqrt{t_c} \qquad \text{(Equation 2)}$$

where:

alpha is a constant near unity;

$C_N$ is the concentration of the adsorbed surface nitrogen;

$F_M''$ is the free strengthening element concentration in the steel;

$D_N$ is the diffusion coefficient of nitrogen, and $t_C$=t−0.25 where t is the time of nitriding in hours.

β is the slope of nitriding depth vs. square root of time for a particular nitriding temperature and gas composition, as in FIG. 7 (nitriding temperature=1050° F. and with 10% ammonia, 90% nitrogen), and $\text{beta}^2=\alpha C_N D_N/F_m$.

Insofar as some of the terms in the equation above are not directly readily measurable experimentally, the slope of the nitriding depth vs square root of time would normally be determined by hardness traverses after nitriding less than full thickness.

FIG. 7 relates depth of nitriding with time, specifically the square root of time, at various nitriding temperatures, and for a DDQSK-FS base steel sheet containing 0.77 weight percent Ti as the strengthening element. For this purpose, mixtures of 10% ammonia with nitrogen were used at 1050° F. in a laboratory tube furnace which produces transient type laminar flow. From this figure it can be seen that the depth of the nitrided front in the steel, x, increases linearly with the square root of time. The use of different buffer gases such as argon or hydrogen would not change the depth relationships of FIG. 7 provided the ammonia concentration is unaltered. This parabolic rate of nitriding provides specific numbers on the rate of nitriding, allowing for exact prediction of the time required to nitride a sheet to a particular depth or through thickness in a sheet of particular gauge. Also shown is an estimate of the nitriding depth for fully developed laminar flow with sheet chemistry and gas delivery flow essentially identical to the transient flow line. The fully developed laminar flow estimate is based on nitrogen absorption values from laminar and transient flow regions. At temperatures less than 1150° F., where nitrogen gas solubility in steel is low, there is essentially no dependence of the nitriding depth-time relationships on the use of any of the three proposed buffer gases, nitrogen, hydrogen and argon. Such accurate prediction is not possible with information available in the prior art.

These mechanisms provide a secondary method of strength control which is achieved by nitriding for a shorter time so that only a fraction of the sheet thickness is nitrided and in such a way that strength uniformity of the steel sheet is not reduced, that is, by nitriding for a limited time at a constant temperature shelf in a restricted temperature range, in an open coil annealing furnace with nitriding gas maintained in turbulent flow in the open coil wraps.

We have developed a further relationship to determine the yield strength to be expected in DDQSK-FS steel sheet that has been only partially nitrided, i.e.:

$$\sigma_P = 2\beta T_S^{-1}(\sigma-\sigma_B)\sqrt{t_C}+\sigma_B \qquad \text{(Equation 3)}$$

where $\sigma_P$ is the partially nitrided yield strength;

$\sigma$ is the fully nitrided maximum yield stress for sheet of thickness such that t is the full nitriding time required for the nitriding temperature employed;

$\sigma_B$ is the base sheet yield strength;

$t_C$=t−0.25 where t is the partial nitriding time, hours;

$T_S$ is the sheet thickness, inches, and $\beta$ is a constant the value of which is obtainable from the slope of Equation 2 at a particular nitriding temperature (see FIG. 7).

Some hardening occurs by nitrogen leakage through the front which increases the base strength. This leads to a slightly higher base strength for the partial strength equation than used in Equation 2. Strickly speaking, there can be two different base strengths in Equation 3 but, for simplicity, we only use one.

Thus, in accordance with the invention, nitriding can be carried out with accurate hardening and strengthening of the entire sheet thickness, or the nitriding depth of hardening and strengthening can be only partial or case hardening, for example, in the production of dent-resistant sheet. By applying a barrier layer or poison to one surface of the sheet assymetrical hardened sheet may be made for special applications.

Figure 10A:
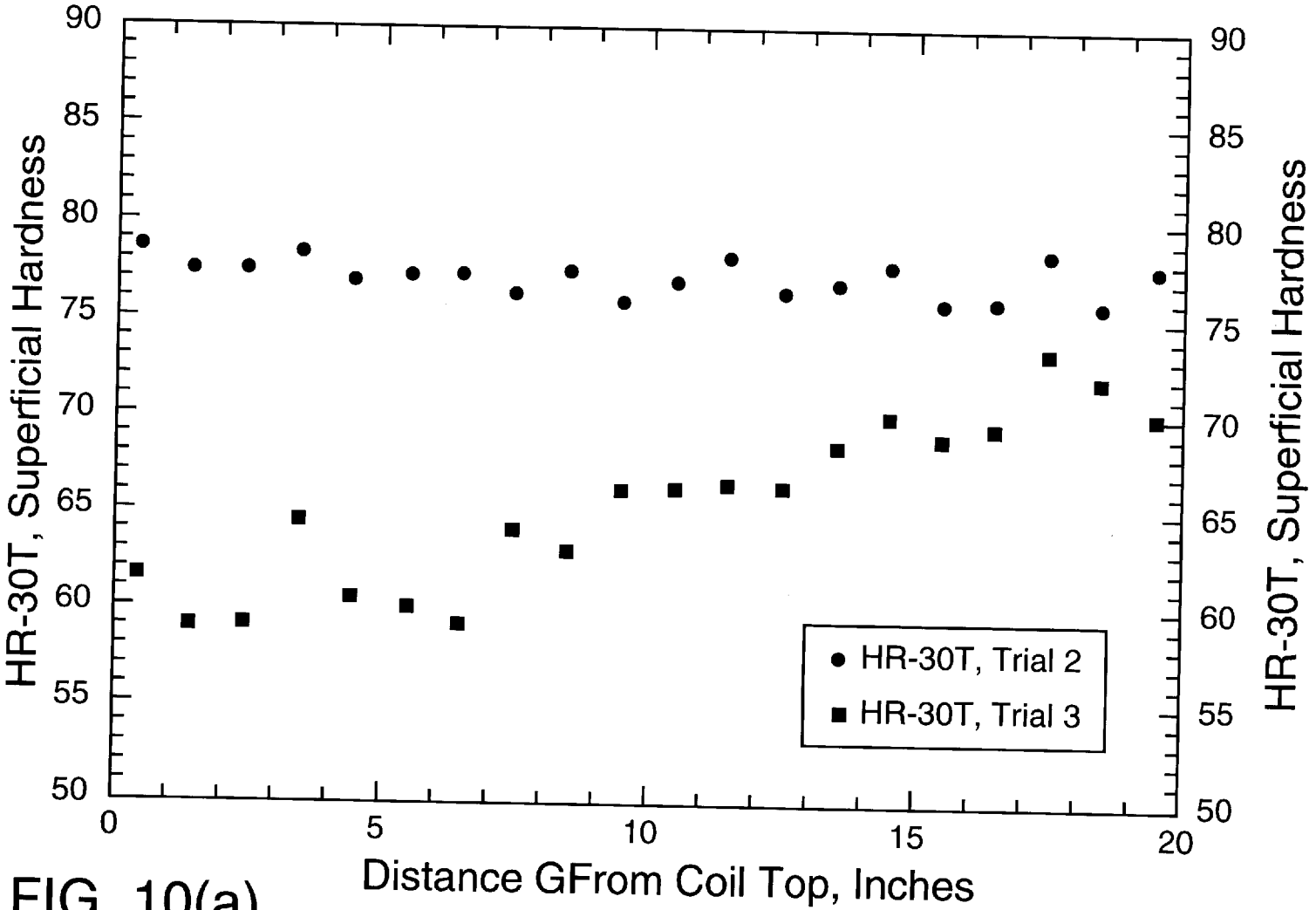
FIGS. 10(*a*) and 10(*b*) are graphs relating, respectively, hardness traverses and lower yield values and the distance from the top edge of the coils nitrided in the same two trials.
Figure 10B:
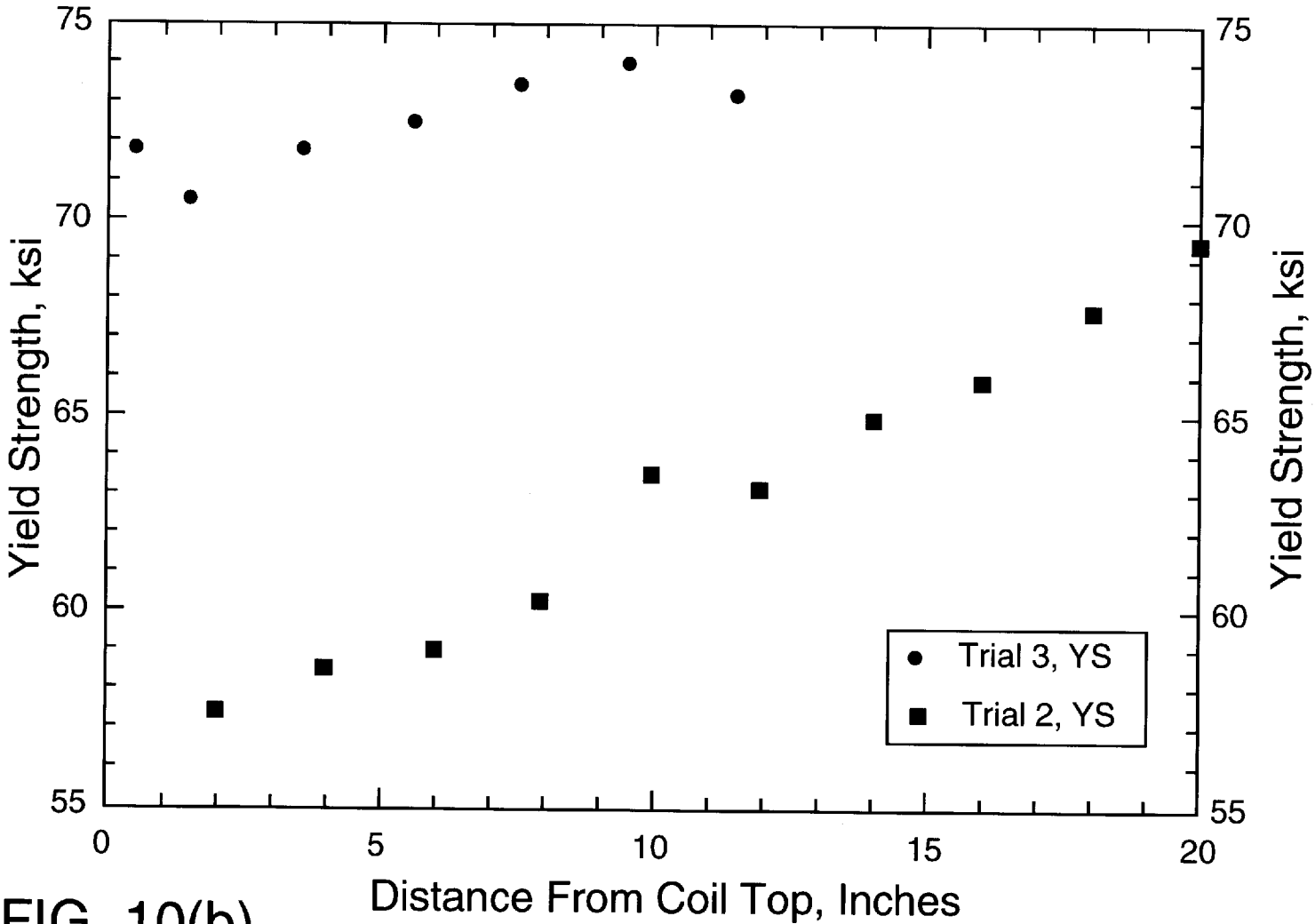
Figure 11:
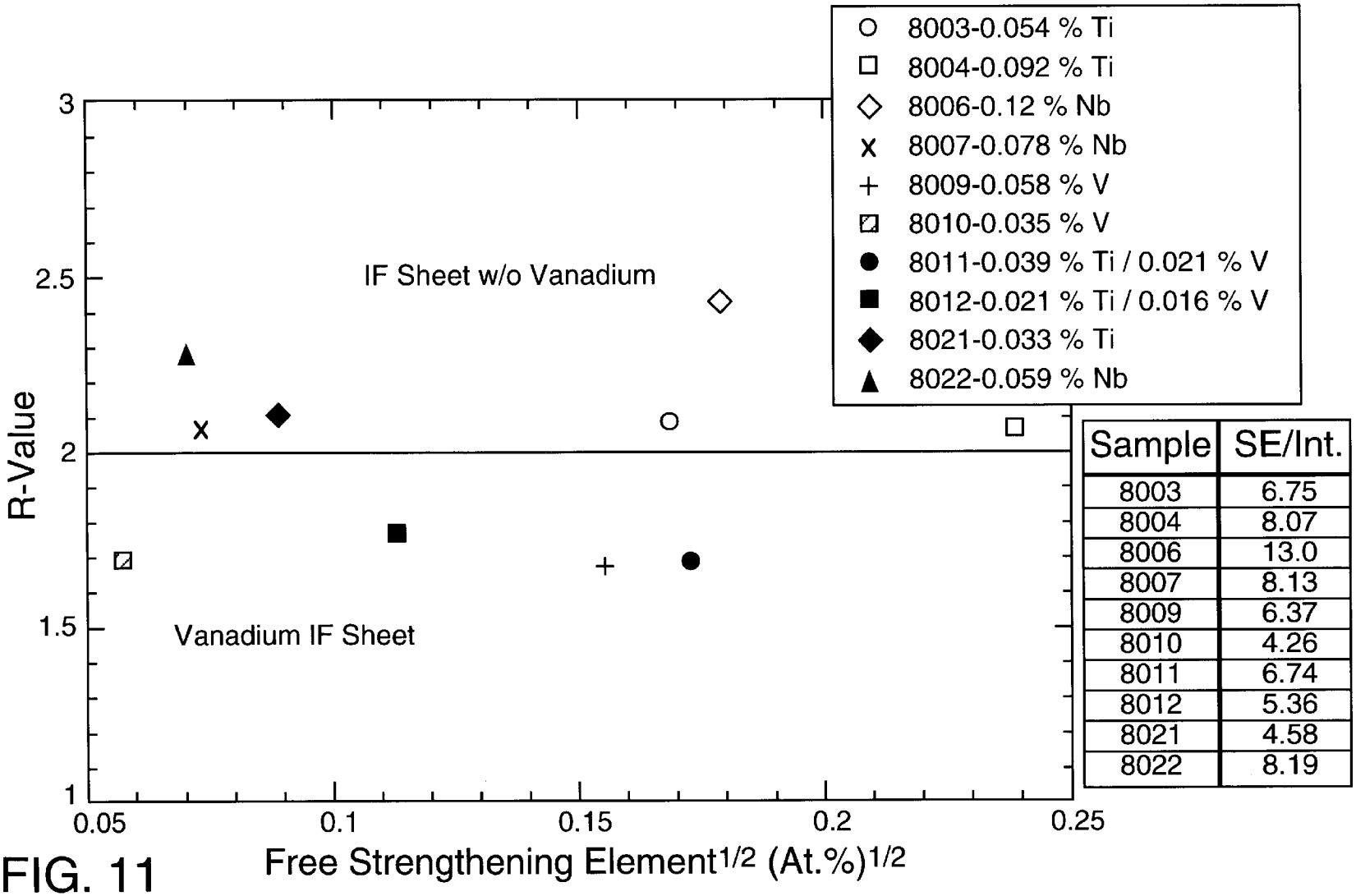
FIG. 11 is a graph relating amount of available strengthening metal with the r values obtained after laboratory processing sheet of different composition in a manner consistent with the processing according to this invention.

In FIG. 10 the r values obtained for sheet steels using titanium, niobium and vanadium as strengthening elements and processed according to this invention are shown. The steels richest in vanadium developed the weakest <111> texture and exhibited the lowest r value. Insofar as vanadium develops a weak texture and presents some difficulty in predicting nitrided stength, it is the least desirable element if drawability is required.

Illustrative of the invention, a steel was made with the following composition:

TABLE I

| Element | Weight Percent |
|---|---|
| carbon | 0.004 |
| manganese | 0.20 |
| phosphorous | 0.009 |
| sulfur | 0.008 |
| silicon | 0.008 |
| molybdenum | 0.007 |
| aluminum | 0.032 |
| nitrogen | 0.004 |
| oxygen | trace (about 12–15 ppm) |
| titanium | 0.033 |
| niobium | 0.036 |
| vanadium | residual 0.001 |
| copper | residual - 0.019 |
| nickel | residual - 0.02 |
| chromium | residual - 0.03 |
| tin | residual - 0.002 |
| boron | residual - 0.0001 |
| iron | balance |

In general, the amounts of incidental elements in the steels contemplated by this invention are limited as follows, in weight percent: 0.02% P, 0.04% Cu, 0,04% Ni, 0.04% Cr and 0.02% Mo.

The heat of Table I was made using DDQSK-FS practice, by degassing to reduce carbon interstitials, followed by deoxidatiion, and finally adding the strength-forming elements, titanium and niobium in the amount required for the yield strength aim. The steel, in slab form, was soaked at 2250° F. and hot rolled in the austenite range, finishing at 1730° F. with a hot strip thickness of 0.170 inch and coiled at a coiling temperature of 1175°–1225° F. The hot rolled strip then was cold rolled to a thickness of 0.031 inch, a width of 46 inches, and coiled into 10 ton coils.

In a first experiment, a coil was placed on the base of an open coil annealing furnace modified to admit nitriding gases at the furnace base and which gases were circulated to enter the top of the coil. A 70 mil wire was used to separate the wraps. The closed furnace was purged for 1 hour with nitrogen at 1800 cubic feet per hour (cfh). The furnace was fired to heat with a setpoint at 1500° F. At 1500° F., gas was switched to HNX (8–10 vol. % ammonia, balance hydrogen) at 1500 cfh until a No. 2 thermocouple (located at the experimentally-determined "hot spot" on the outside and near the top edge of the coil) reached 1100° F., and the furnace controlled to maintain the latter temperature. When a No. 3 thermocouple (located at an experimentally-determined "cold spot" on the inside wrap at the bottom edge of the coil) reached 1050° F., a wet gas cycle was started to prevent nitrogen pickup, and the dewpoint was maintained at 40° F.+ or −20° F. The furnace then was fired to a temperature of 1550° F. until the No. 2 thermocouple reached 1300° F. and the furnace was maintained at the latter temperature. When the No. 3 thermocouple reached 1275° F. (after about 2 hours), heating was discontinued and the coil was allowed to cool in the furnace, while maintaining the wet gas atmosphere. When either the No. 3 thermocouple reached 1150° F. or the No. 2 thermocouple reached 1100° F., the wet gas atmosphere was discontinued and the gas switched from HNX to nitrogen at 1500 cfh. When the No. 3 thermocouple reached 1050° F., the furnace was again fired to maintain the No. 2 thermocouple at 1050° F. At that time, and when the No. 3 thermocouple was within 20° F. of 1050° F., and after a further 30 minute hold, then a nitriding gas was introduced into the furnace at a flow rate of about 1500 cfh, for 3½ hours. The gas then was switched to HNX at 1500 cfh, the furnace was shut down and the coil was allowed to cool. When the No. 3 thermocouple reached 600° F., cooling water was turned on, and when that thermocouple reached 240° F., the base was split (cover removed) and the coil removed.

In this initial commercial scale trial, the composition of the nitriding gas was not well controlled. The initial ammonia levels exceeded 8% but diminished over the first half of the nitriding cycle to about 3 vol. % ammonia in nitrogen where it remained during the last half of the nitriding shelf time. This coil was nitrided 1.5 hours longer than required for full nitriding at the intended 8% gas charging rate. Nevertheless this resulted in nitrogen levels everywhere that were nearly sufficient to produce maximum strength. Table 2 shows some results from this trial.

TABLE 2

Properties across Width of Nitrided Sheet - Trial 1

| Property | Top | Center | Bottom |
|---|---|---|---|
| 30T Hardness (OW)* | 66 | 71 | 67 |
| 30T Harnness (IW)* | 64 | 69 | 69 |
| Nitrogen level (OW) | 0.017 wt. % | 0.025 wt. % | 0.020 wt. % |
| Nitrogen level (IW) | 0.014 wt. % | 0.026 wt. % | 0.028 wt. % |
| Lower yield stress (OW) | 64 ksi | 65 ksi | 62 ksi |
| Lower yield stress (IW) | 54 ksi | 63 ksi | 65 ksi |
| Em (OW and IW), psi | $32.6 \times 10^6$ | $32.6 \times 10^6$ | $32.6 \times 10^6$ |
| $gamma_m$ (OW) | 2.1 | 2.1 | 2.1 |
| $gamma_m$ (IW) | 2.1 | 2.1 | 2.1 |

*OW and IW stand for Outer and Inner Wraps of the open coil.
** R-value as measured by MODUL-R As is seen from Table 2, HR30T hardness was substantially constant across the sheet width and from head (outside wrap) to tail (inside wrap) of the coil, only being somewhat lower at the top and tail of the coil than in the other measured locations. (HR3OT hardness is Rockwell superficial hardness obtained with use of a 1/16 inch diameter ball and a 30 kg. load.) Similarly, yield stength was substantially uniform throughout the width and length of the coil, only an the top of the tail was it somewhat lower. Nitrogen level was quite uniform, at the center and bottom but, at both head and tail of the coil; nitrogen was somewhat lower at the top of the coil. Notably, nitrogen level was somewhat lower at the top of the coil (where the nitriding gas flow was in a transition mode before fully developed laminar flow) than at the center and bottom of the coil (where gas flow was fully developed laminar type). This test, while producing relatively good results, was deemed only partially successful because of uncertainty in gas composition.

Therefore, a second commercial scale experiment was carried out in which the same steel, at the same thickness, same wire size and the same coil weight, was subjected to the same annealing and nitriding time, except the composition of the introduced nitriding gas was held substantially constant at 8 vol. % ammonia in nitrogen and the exhaust gas from the coil bottom was analysed. In this case, the exhaust from the furnace inner cover—which is the same composition as the gas in contact with the sheet surface—contained about 3 to 5 vol. % ammonia. The hydrogen present was about twice the ammonia level in the exhaust gas. The temperature difference between the hot spot and the cold spot of the coil while being nitrided was always less than 10° F. and usually less than 2° F. Some further test results are shown in Table 3 and FIGS. 8 and 9A and 9B.

TABLE 3

Tensile Results from Outside and Inside Wrap Samples - Trial 2

| Sample ID | Low Yield, ksi | UTS, ksi | n-Value* | Total Elongation, % |
|---|---|---|---|---|
| Outside -1-L(1) | 71.2 | 82.7 | 0.16 | 21.6 |
| " -1-T(2) | 71.5 | 81.6 | 0.14 | 21.2 |
| " -7-L | 71.2 | 82.2 | 0.16 | 22.4 |
| " -7-T | 72.4 | 81.3 | 0.15 | 21.6 |
| Inside -1-L | 76.9 | 91.0 | 0.15 | 19.1 |
| " -1-T | 78.6 | 88.6 | 0.13 | 18.2 |
| " -7-L | 76.6 | 90.6 | 0.15 | 17.5 |
| " -7-T | 78.3 | 83.8 | 0.14 | 20.6 |

(1)Longitudinal sample
(2)Transverse sample
*n value measured from end of lower yield extention to the maximum load.

TABLE 4

Tensile Results Across Width in an Outside Wrap Sample - Trial 2

| Sample ID | Low Yield, ksi | UTS, ksi | n-Value* | Total Elongation, % |
|---|---|---|---|---|
| Outside -1-T | 71.8 | 81.3 | 0.15 | 19.3 |
| " -2-T | 70.6 | 81.9 | 0.16 | 21.4 |
| " -4-L | 71.8 | 82.7 | 0.16 | 21.7 |
| " -6-T | 72.6 | 83.3 | 0.16 | 22.5 |
| " -8-T | 73.5 | 84.2 | 0.16 | 21.8 |
| " -10-T | 74.0 | 84.5 | 0.16 | 21.8 |
| " -12-T | 73.2 | 84.0 | 0.16 | 21.5 |

(1) Longitudinal sample
(2) Transverse sample
*n value measured from end of lower yield extention to the maximum load.

The preferable type of flow between the wraps of the open coil is fully developed laminar flow, although fully developed turbulent flow may be use, but is difficult to achieve. While the Reynolds number for the nitriding gas mixtures at the nitriding shelf temperature is not precisely known, it certainly falls in the lower limit of the laminar flow range of about 1 to 1500, e.g. about 20. Fully developed laminar flow requires a distance from the coil top gas entrance to establish itself. The flow in this transition zone is called transitional flow. A high mass transfer boundary layer next to the sheet surface is associated with flow both in the transitional and fully developed laminar region. Reduced nitrogen absorption in the transition zone relative to the fully developed laminar flow region indicates that the density of adsorbed nitrogen on the sheet surface is reduced in this region. The reason for this reduction is unknown at this time.

Figure 9:
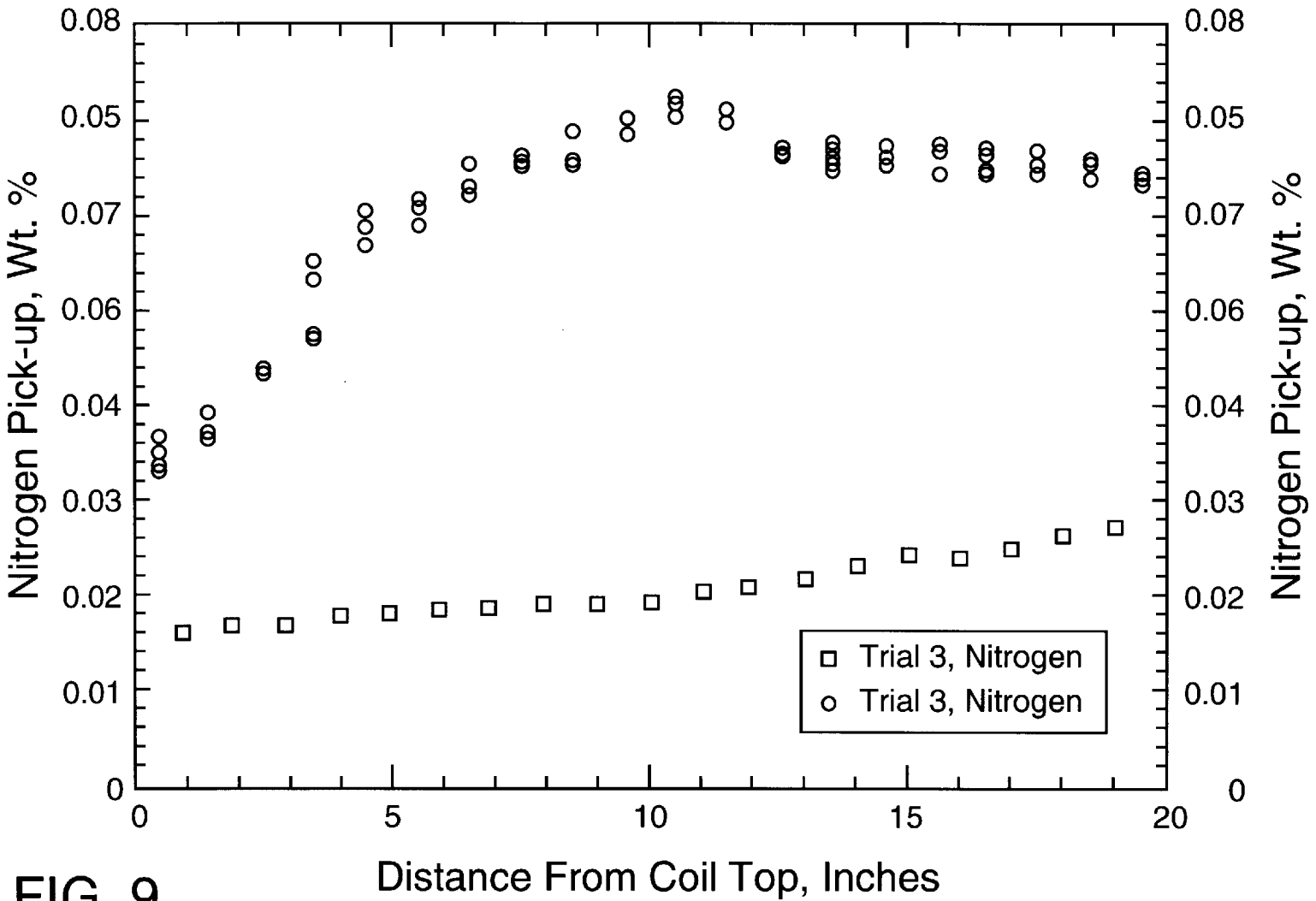
FIG. 9 is a graph relating the amount of nitrogen pickup during nitriding vs. the distance from the top of the steel coil being nitrided in an open coil annealing furnace, wherein nitrogen profile data for trials 2 and 3 (as hereinafter described) are shown.

The rate of nitriding gas mixture recirculation within the wraps of the coil in the open coil annealing furnace results in fully developed laminar gas flow in the lower half of the coil but with some transition laminar flow with its associated reduced nitrogen absorption near the coil top. In the transient flow region the adsorbed nitrogen on the sheet surface is sufficient to fully nitride the cross section and a relatively small amount of excess nitrogen is also deposited. In the full laminar flow conditions from the middle of the coil to the bottom the sheet is fully nitrided and large amounts of excess nitrogen are also present. In FIG. 9 the nitrogen levels across the top 20 inches of the coil are shown. The substantial uniformity of longitudinal and transverse properties—yield strength, ultimate tensile strength, n-value and total elongation—across the width of the coil and from head to tail, is clearly seen from the data of Table 3. Table 4 illustrates the uniformity of lower yield stress across the top 12 inches of the coil head. The lower yield stress was substantially uniform at head and tail over the bottom 34 inches of this coil.

Such uniformity of properties of sheet produced in accordance with this invention, together with the amount of nitrogen pickup, after nitriding, is even more clearly evident from FIGS. 9 and 10(*a*) and 10(*b*). Thus, in FIG. 10(*b*), it is seen that the yield strength in trial 2 is maintained substantially constant over the width of the coil from the top edge to the center of the coil. At the top of the coil, to the left of FIG. 9, the nitriding gas flow, entering the furnace near the top edge of the coil, is transient laminar flow. At the right side of FIG. 9, representing the center of the coil, the nitriding gas flow is fully laminar. The region in the center of FIG. 9 is a transition region, wherein the gas flow is changing from fully laminar to transient. As seen in FIG. 9, nitrogen pickup increases with increasing distance from the top of the coil, until a peak is reached when full laminar flow becomes predominant and continues at a substantially constant level of 0.07 wt. % toward the center of the coil. In both trials 2 and 3, FIG. 9, there is a reduction in absorbed nitrogen at the top of the coil associated with transition flow in this region.

Similarly, FIG. 10(*a*) shows substantially constant hardness across the width of the nitrided sheet from trial 2, at both the head and tail of the coil. This coil was also 0.030 inches thick. The nitriding time at 1050° F. was 3.5 hours, whereas only 2 hours was necessary for full nitriding under full laminar conditions. The ammonia concentration was increased to 10% during the last 30 minutes of nitriding. The long nitriding time accounts for the high nitrogen level in this sheet. Without the extended nitriding time, the yield stress would have been lower near the top surface where low nitrogen absorption due to transient flow locally was observed. However even in the transient laminar flow region full thickness nitriding occurred, so little reduction in yield stress was observed in this area. $Fe_4N$ precipitates formed on cooling in full laminar flow regions of this sheet in the open coil annealing furnace.

A third trial was conducted using a titanium stabilized steel shown in Table 5.

TABLE 5

| Element | Weight Percent |
|---|---|
| carbon | 0.004 |
| manganese | 0.205 |
| phosphorous | 0.01 |
| sulfur | 0.005 |
| silicon | 0.008 |
| molybdenum | 0.004 |
| aluminum | 0.029 |
| nitrogen | 0.003 |
| titanium | 0.062 |
| niobium | <.001 |
| vanadium | <.002 |
| copper | residual 0.018 |
| nickel | residual 0.02 |
| chromium | residual 0.02 |
| tin | residual <.002 |
| boron | residual <.0001 |
| iron | balance |

The coil used in this trial was also 0.030 inches thick with a width of 39 inches. The interwrap separating wire used was 70 mils. The 2 hour nitriding time employed, using 8% ammonia with nitrogen buffer gas, was just sufficient to fully nitride the thickness in the fully developed laminar flow region. All processing prior to nitriding was the same as trial 2.

The results of trial 3 also are illustrated in FIGS. 8 and 9(*a*) and 9(*b*). In trial 2, in which the coil was nitrided for 3.5 hours, the hardness and yield stress values are essentially constant at all positions in the coil. In trial 3 sheet of the same thickness as that used in trial 2 was nitrided for 2 hours. In the entry gap transition flow region, full thickness nitriding does not occur and softness results. In the tail region transient laminar flow conditions near the top edge has resulted in partial nitriding through thickness and hence lower yield stress and hardness values than in the full laminar flow fully nitrided region near the midwidth position. As in the previous trial when the transient to full laminar transition is seen in the region near the coil top edge, the difference in the absorbed nitrogen levels is approximately a factor of two.

Figure 12:
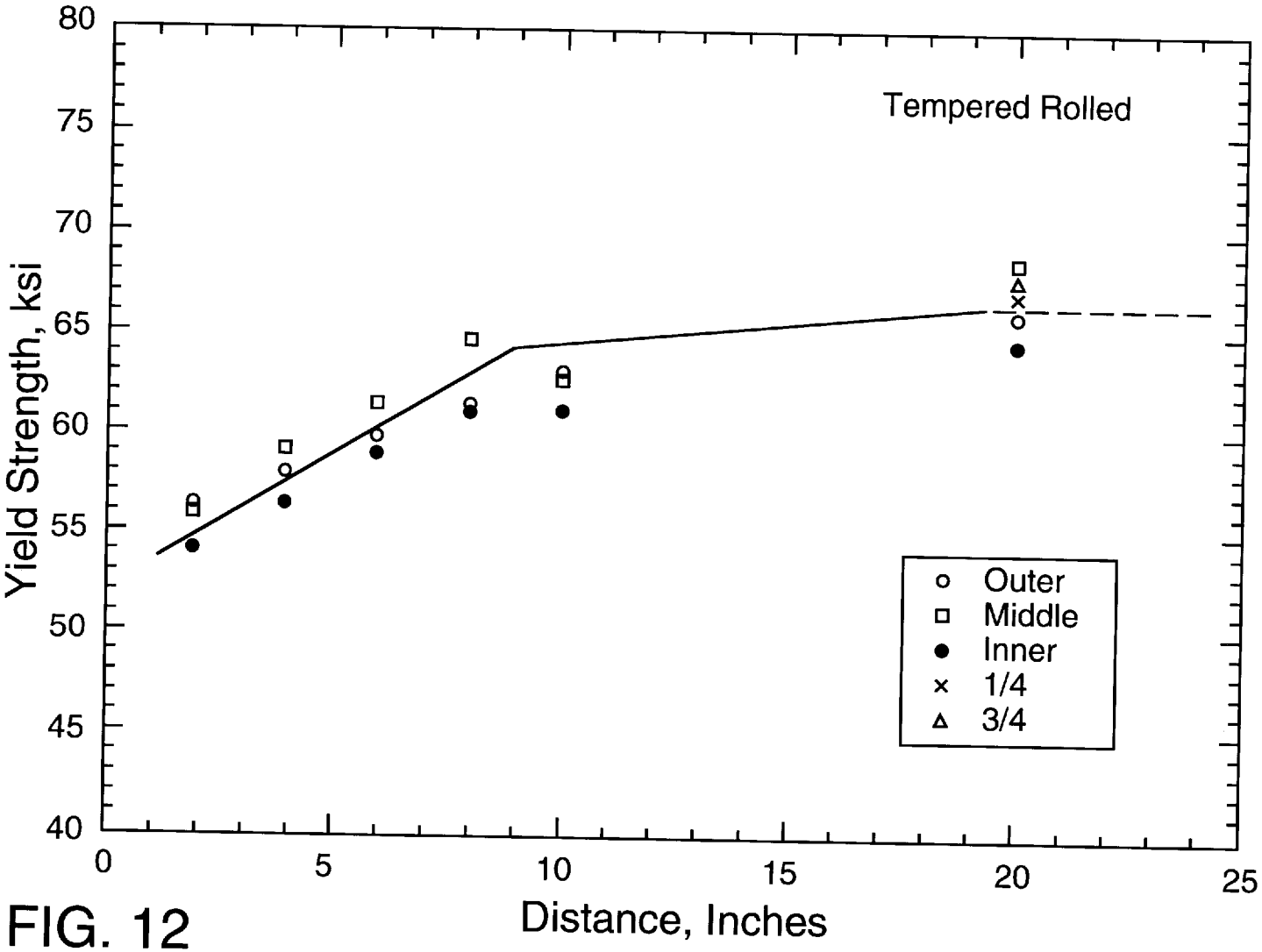
FIG. 12 is a graph relating the distance from the top edge of nitrided coil and 0.2% yield strength values obtained from temper rolled sheet on trial 3 as hereinafter described.

FIG. 12 shows the 0.2% yield strength variations, in trial 3, from the top edge of the coil across the width at five positions along the coil length after temper rolling 0.75% by extension. These results indicate that head to tail variations are small and that improvement is required primarily in the transverse variation in yield stress due to change in gas flow characteristics. Where the yield stress was low near the top edge of the sheet, the cross section was not fully nitrided as it was in the full laminar flow plateau region below about 10 inches from the coil top, due to low nitrogen absorption in this region. The mechanical properties and the nitrogen absorption in the bottom half of the coil width were substantially the same everywhere.

The maximum nitrogen absorption in this trial 3 coil is about 0.03 wt. %. When sheet from fully nitrided parts of this coil is temper rolled 0.75% to remove the yield point and is subsequently given a 1 hour anneal at 180° F. to simulate long term storage, the yield point did not return. The absence of strain aging indicates that the coherent precipitates produced by nitriding are capable of binding or immobilizing large amounts of interstitial nitrogen. Autogenous welds using laser heating, TIG processing or copper electrode spot welding showed no gas evolution or unusually high or low hardness values in the weld metal or surrounding HAZ (heat affected zone).

The hot band used to make the cold rolled sheet used in trials 4 through 6 was a titanium stabilized DDQSK-FS grade essentially similar to that used in trial 3 except that the titanium, nitrogen and carbon levels produced a steel with 0.039 at.% free titanium. The results of trials 3 through 6 were useful for testing the partial nitriding strength Equation (3). We were able to get two effective thicknesses for each coil by measuring the lower yield stress at positions in the coil where the aim thickness of 0.041 inch was obtained and also near the tails where the roll separation was increased to approximately 0.050 inch. The partial nitriding times varied between 1 hour and one hour and 50 minutes.

Figure 13:
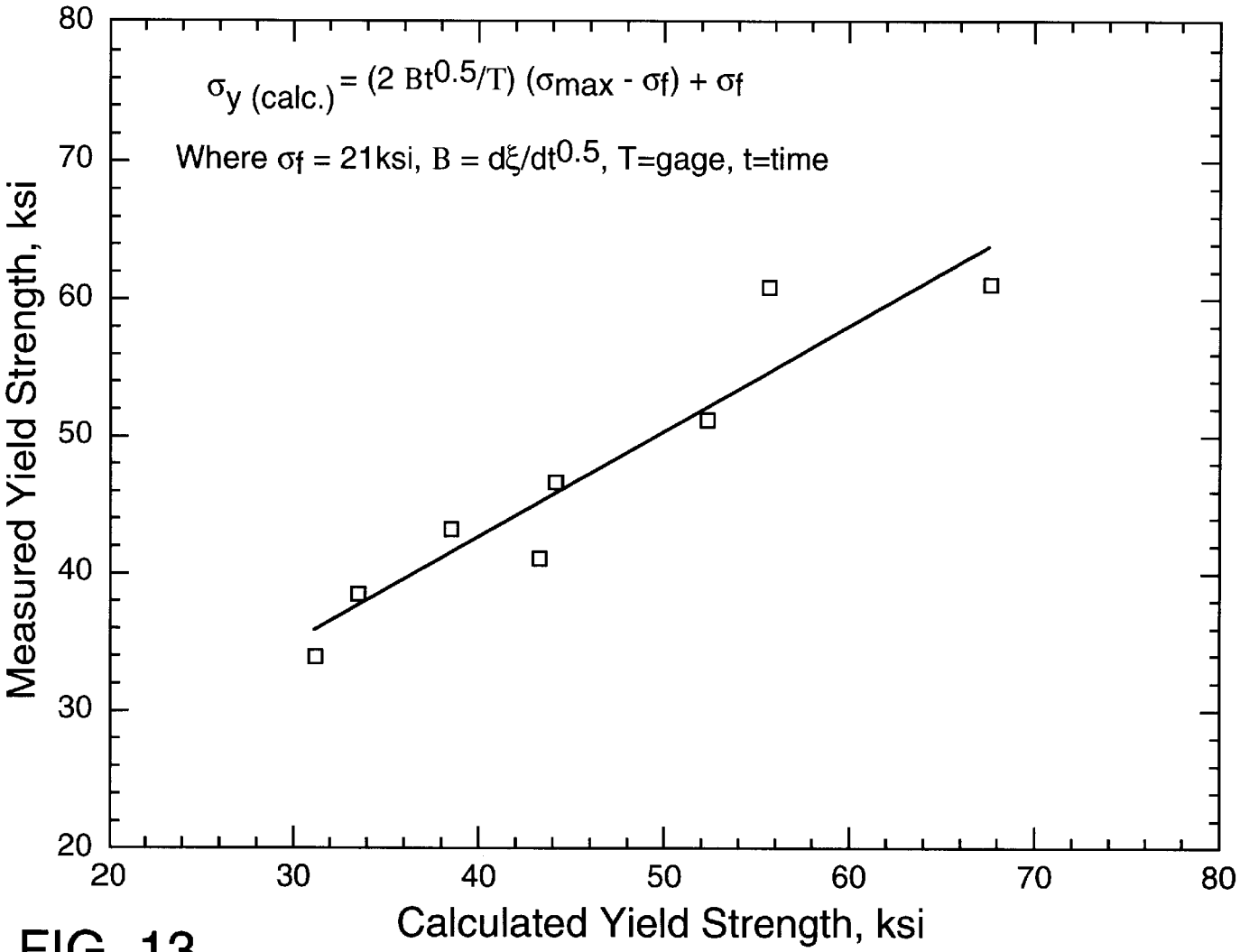
FIG. 13 is a graph comparing the measured and calculated lower yield stress of partially nitrided cold rolled sheet.

In FIG. 13 we show the results of the actual measured partially nitrided yield strengths taken from the full laminar region of gas flow between the wraps plotted against the calculated yield stess from Equation 2. These data were taken from trials 4, 5, 6, 7 and 8 which were conducted under the same conditions as trials 2 and 3, except for nitriding time. The predicted strengths and measured strengths substantially agree using this simple equation with $\beta$=0.0085 (the approximate value for a 4% ammonia - buffer gas mixture in the interwrap space under laminar flow) and $\sigma_B$ set to 21 ksi. However the linear relationship does provide a basis for predicting the partial nitriding strength of coils using historical data. In very thick sheet and long nitriding times, where hardness sometimes builds up ahead of the internal nitride front and occurs by leakage of nitrogen through the front, more complex relationships between partial nitriding strength and nitriding time prevail; nevertheless historical data can be used to accurately predict yield strength.

Trials 7, 8 and 9 were different in two respects from earlier trials. A modification to the OCA base was made to reduce the leakage of gas circulation outside the coil and a larger wire (0.090 inches diameter) was placed between the wraps. These changes were made to reduce the transition flow zone near the top of the coil that had been observed in all previous trials. In addition a sheet thickness of 0.039 inch was used for the cold rolled sheet in trials 7 and 8. Trial 9 was austenite finished hot rolled sheet of 0.078 inch thickness. The processing of this sheet was the same as for cold rolled sheet except that the cold rolling step was eliminated and the hot rolled final thickness was reduced. The titanium stabilized steel used in trials 7 and 8 was essentially similar to that used in trial 3 except that the free titanium this time was 0.04 at. %.

Figure 14:
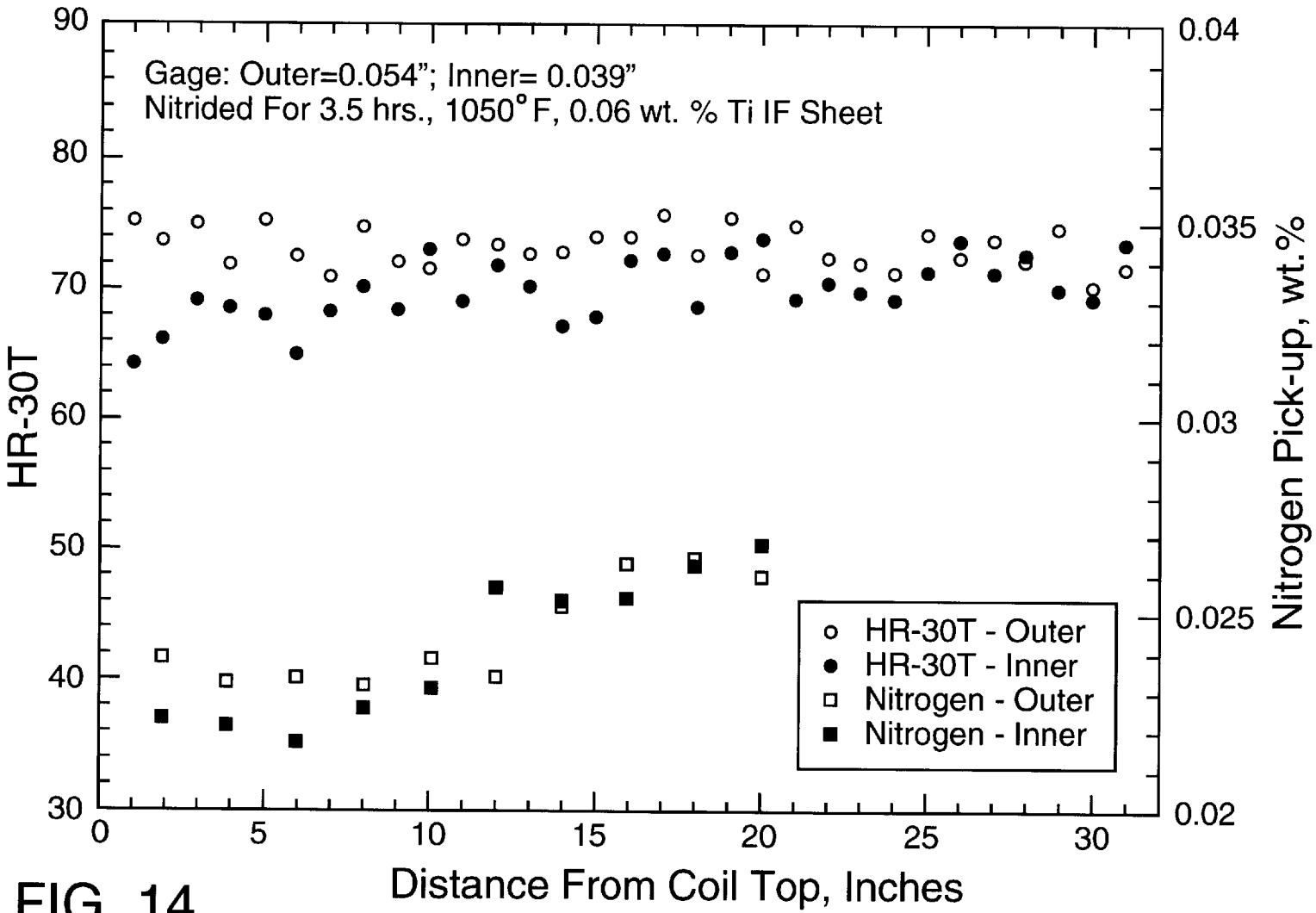
FIG. 14 is a graph showing nitrogen and hardness traverses near the top edge of the coil from trial 7, as hereinafter described.

FIG. 14 summarizes some of the salient results of trial 7. This figure shows hardness and nitrogen traverses from outside (head) and inside (tail) wraps of a coil that was nitrided for 3.5 hours. This behavior can be compared to trial 3. The nitrogen levels fall by 20% near the top edge of trial 7 compared to 100 % change in trial 3. There is no fall off in the hardness data near the top edge of the coil. This is very clear evidence that the changes made between trials 3 and 7 produced significantly less transition type gas flow.

Figure 15:
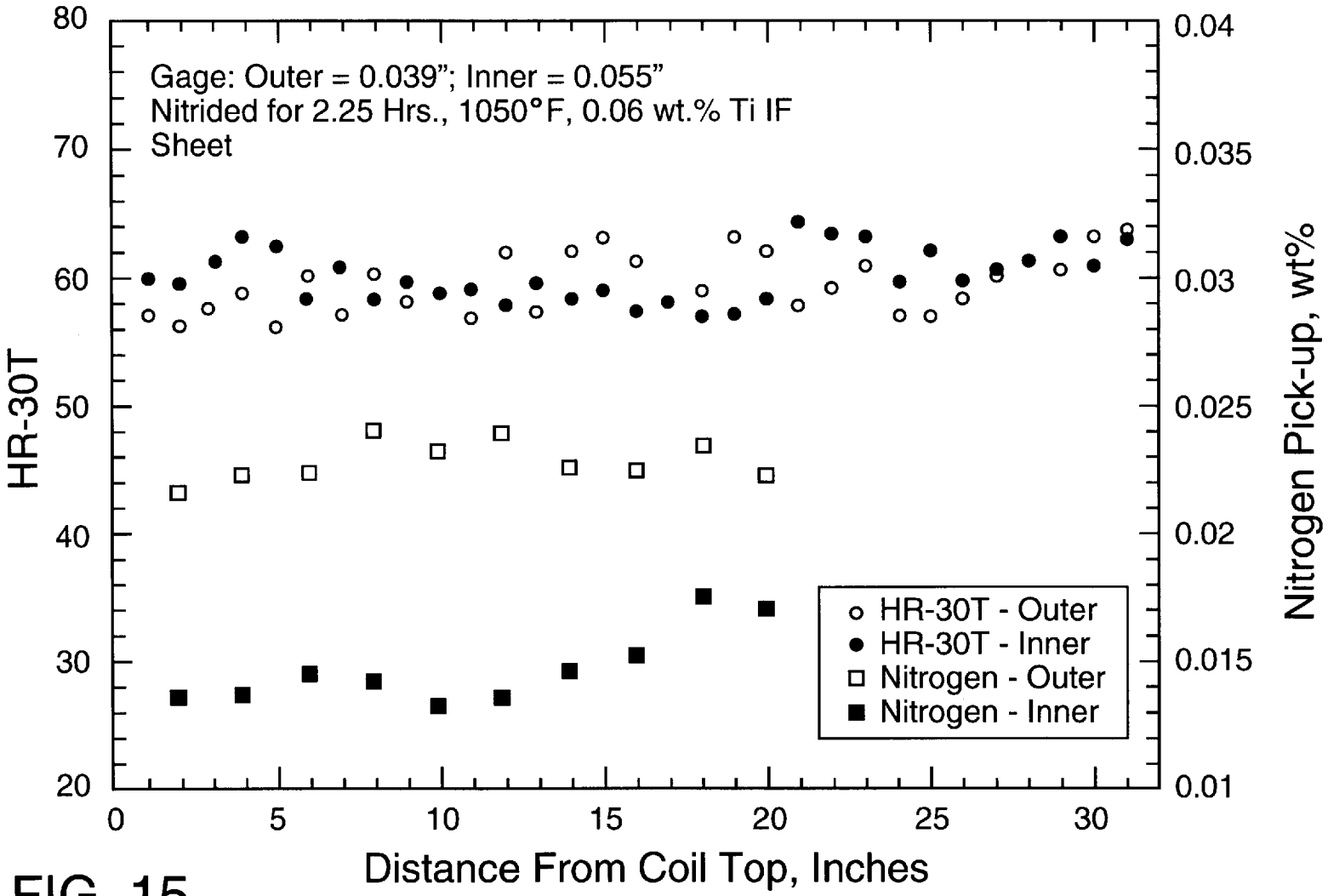
FIG. 15 is a graph showing nitrogen and hardness traverses near the top edge of the coil from trial 8, as hereinafter described.

FIG. 15 shows the same results from a coil made from the same cold rolled stock that was partially nitrided for 2.25 hours in trial 8. Again there is only a small fall off in either nitrogen or hardness values near the coil top. However nitrogen pickup in the outside wraps is greater than near the tail position which is due to the sheet thickness difference of 39 and 55 mils. Again transition flow has been markedly reduced in this test resulting in nearly uniform mechanical properties with low excess nitrogen and considerable strength reduction through partial nitiriding.

TABLE 6

Temper Rolled Tensile Properties and Nitrogen Absorption Across the Width of the Inner Wraps From Trial 8

| Sample Position | Yield Stress 0.2% offset, ksi | Total Extension | Weight % n Value | Weight % Nitrogen |
|---|---|---|---|---|
| Coil Top | 60 | 25 | 0.15 | 0.027 |
| | 61 | 25 | 0.15 | 0.029 |
| | 64 | 24 | 0.15 | 0.031 |
| Center Line | 65 | 23 | 0.15 | 0.031 |
| | 65 | 23 | 0.14 | 0.031 |
| | 67 | 23 | 0.14 | 0.033 |
| Coil Bottom | 68 | 22 | 0.14 | 0.035 |

The 0.75% extension temper rolled tensile test results taken from the inner wraps of Trial 8 shown in Table 6 above do not show quite the same uniformity as the hardness results. There is both a drop off in nitrogen and yield stress values at the top edge of the coil, near uniformity in the center line region, and a rise in both yield stress and absorbed nitrogen near the bottom of the coil. The total extension and work hardening exponent n values obtained are nearly constant and very good for this strength level sheet. The increase in strength and nitrogen absorption at the bottom of the wrap is not fully understood. However, if the OCA had an internal circulation fan that could be reversed periodically during nitriding, the non-uniformity of the transverse mechanical properties could be largely eliminated. The cross width tensile results taken from the outer wraps are essentially identical to those in Table 6. A general conclusion that may be drawn from these partially nitrided coils is that uniformity of properties is lower than for fully nitrided sheet.

Figure 16:
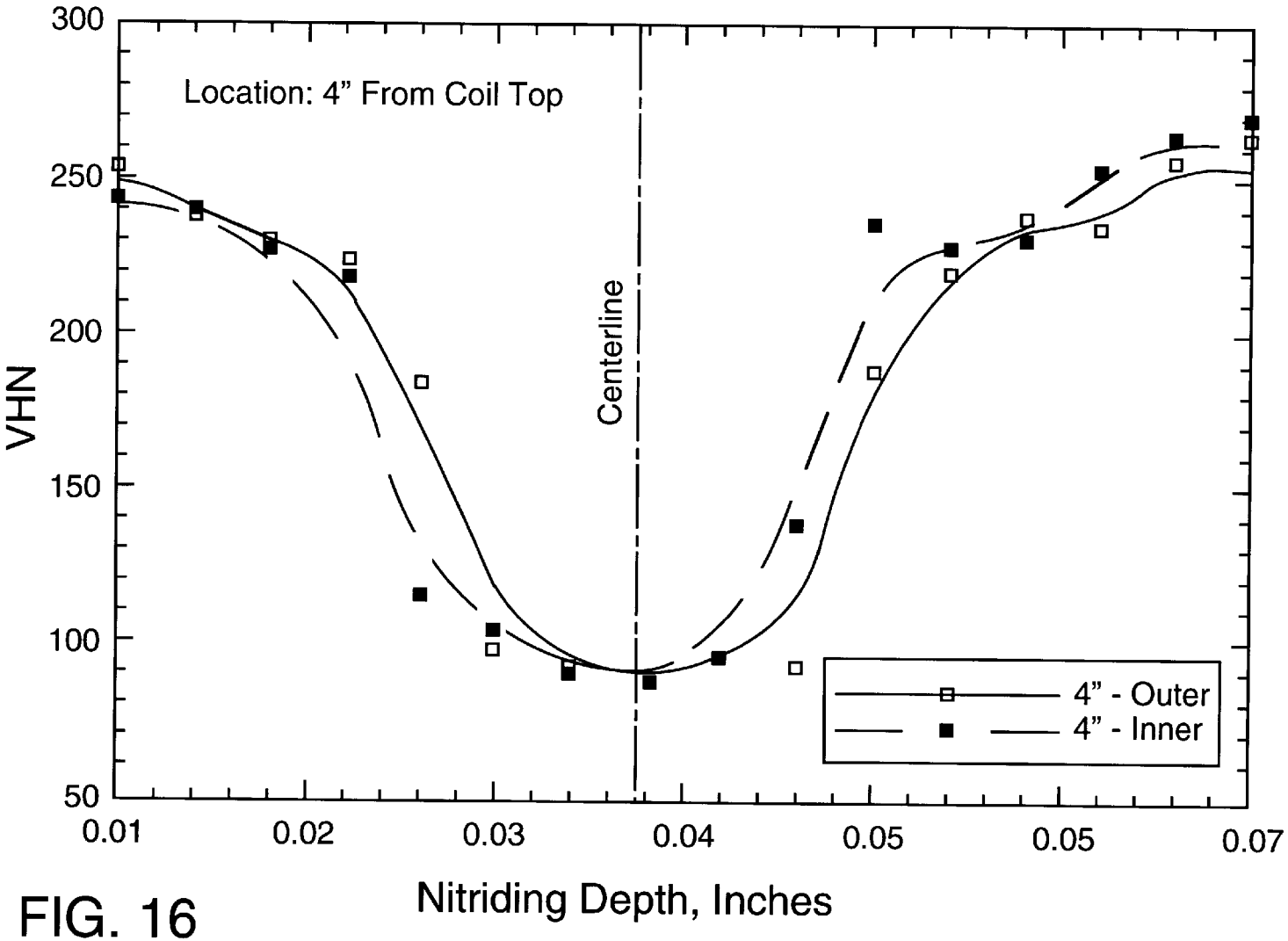
FIG. 16 is a plot of a hardness traverse from edge to edge taken from nitrided hot rolled sheet made in trial 9, as hereinafter described.

Trial 9 was different from all previous tests insofar as the base stock used in the OCA was austenite rolled sheet 32 inches wide and 0.078 inches thick. The steel employed for this trial was essentially the same as for Trial 3 except that the free titanium was 0.056 at. %. The nitriding was done for 3.5 hours at 1150° F. without any preceding annealing phase and using a 90 mil wire between the wraps. This nitriding left about 15 mils unnitrided on the sheet centerline as shown in FIG. 16. The nitrogen absorption from edge to edge showed some variation but no roll-off from edge to edge. The mean longtitudinal lower yield stress for this sheet was 72 ksi and the r value was near unity.

A tenth trial employed a large (33,000 pounds) coil of 50 inch width and 24 mils thickness. This coil was open wrapped with a 90 mil wire. The composition of this coil was essentially identical to that of trial 3 except that the available free strengthening element titanium was present in the amount of 0.057 atomic weight percent. This coil was fully nitrided for two hours. Because of the large surface area of this coil the total flow of the 8% ammonia/nitrogen mixture to the inner cover was increased to 1635 cfh. Hardness and nitrogen traverses across the width were made on the inner and outer wraps. The hardness profile was flat at both ends of the coil. The nitrogen profile also was flat with minimal (10%) deficit near the coil top and a smaller increase near the bottom. The size of the region of diminished absorption and the depth of the nitrogen reduction seem to have been minimized by increasing the interwrap wire size and by increasing gas flow through the coil by minimizing leakage past the coil. Both these changes tend to increase the Reynolds number of the gas flow between the sheets. This suggests that more uniform properties might be obtained in the inner circulation rate under the nitriding shelf conditions could be increased and large interwrap gaps be employed. Tensile properties also were obtained from this coil across the width of the sheet. Tables 7 and 8, below, show the results of mechanical testing of this coil after temper rolling using 0.75% extention and demonstrate that uniform properties can be obtained across the width in fully nitrided coils.

TABLE 7

Mechanical Properties From Inside Wraps of the Open Coil Trial 10

| Sample Position | 0.2% Offset Yield, ksi | Total Elongation | n Value 6 to 12% Elongation |
|---|---|---|---|
| Coil Top | | | |
| 2 inches down | 60 | 24 | 0.13 |
| 5 inches down | 60 | 23 | 0.13 |
| 12 inches down | 60 | 21 | 0.13 |
| Coil Center | 61 | 23 | 0.13 |
| 12 inches up | 63 | 24 | 0.13 |
| 5 inches up | 64 | 21 | 0.13 |
| 2 inches up | 64 | 21 | 0.12 |
| Coil Bottom | | | |

TABLE 8

Mechanical Properties From Outside Wraps of the Open Coil Trial 10

| Sample Position | 0.2% Offset Yield, ksi | Total Elongation | n Value 6 to 12% Elongation |
|---|---|---|---|
| Coil Top | | | |
| 2 inches down | 50 | 28 | 0.15 |
| 5 inches down | 50 | 27 | 0.15 |
| 8 inches down | 50 | 27 | 0.15 |
| 12 inches down | 50 | 27 | 0.15 |
| 18 inches down | 50 | 27 | 0.15 |
| Coil Center | 51 | 26 | 0.15 |
| 18 inches up | 52 | 29 | 0.15 |
| 12 inches up | 52 | 25 | 0.15 |
| 8 inches up | 53 | 27 | 0.14 |
| 5 inches up | 53 | 24 | 0.14 |
| 2 inches up | 52 | 21 | 0.14 |
| Coil Bottom | | | |

The results shown in Tables 7 and 8 are very similar in cross width uniformity and in end to end variability to the fully nitrided properties shown in Tables 3 and 4. We have measured a smaller pressure drop across the outer wraps relative to the inner wrap pressure difference which probably accounts for the lower strength developed in this end of the coil. A reduction in the difference of the yield stress from the inner to the outer wraps requires improvements in the uniformity of the gas flow through the coil which can be done by redesigning the OCA base. These results suggest that the easiest way to obtain uniform properties is to use full nitriding and to control strength using the lines of FIGS. 3(*a*), 3(*b*) and 3(*c*) to estimate sheet composition and nitriding temperature to meet a given yield strength aim rather than to use partial nitriding which results in greater nonuniformity of properties. Methods such as partial nitriding require even better control of the gas flow to obtain property uniformity. The strength of the as-nitrided sheet is below that estimated from FIGS. 3(*a*)–(*c*) because the coil surface area was so large that it was not possible to maintain the normal steady state adsorbed nitrogen levels with the delivery flow available (see FIG. 17 and related discussion.)

These trials have demonstrated that nitrogen charging of DDQSK-FS sheet with ammonia buffer gas mixtures can produce drawable sheet of highly controllable strength. Some of the pitfalls encountered in using this methodology have also been discussed.

We have found that, when the nitriding gas ammonia content is held to the range of about 3 to 12%, especially about 6 to 8 up to as high as 12 vol. % under some circumstances, good results are obtained as shown in Tables 2, 4, 7 and 8, and as shown in FIGS. 10 and 12, even near the top edge of the coil where transition to laminar gas flow conditions prevail. This is within a required range of constant nitriding gas flow providing such a ratio that the gas composition at the exit edge of the open coil is about 1 vol. % to about 11 vol. % ammonia to all other gases present in the exhaust gas mixture and providing about 0.5 to about 2 pounds of ammonia per ton of steel per hour. If the ammonia content is appreciably lower, nitrogen pickup may be inhibited, particularity in the transient flow region near the top of the coil. The 3% lower limit on delivered ammonia is chosen partly for practical reasons in that low concentrations slow the nitriding process down which is not commercially desirable. The absorption isotherm slope also steepens at low ammonia concentrations which is undesirable. However, by delivering a low concentration of delivered ammonia mixtures, e.g. about 3%, especially for short times near the end of the nitriding step, lower levels of excess soluble nitrogen are deposited in the steel making non-strain aging steels more readily obtainable. On the other hand, if ammonia is used at the upper end of the range near the 12% level in full laminar flow, especially for times beyond that required for full nitriding are employed and at temperatures above 1090° F., excess soluble nitrogen and $Fe_4N$ formation may result, producing physical properties unsatisfactory for some end use applications.

In general, there are two ways to change the amount of atomic nitrogen delivered to the sheet surface. One is to increase the ammonia concentration and keep the flow rate of the nitriding gas mixture constant. The second method is to increase the flow rate of the nitriding gas mixture to the inner cover of the OCA furnace while keeping the composition of the gas constant. Our measurements of the exhaust gas have shown that the gas in the interwrap space is diluted in ammonia because of decomposition on the large surface area of steel. The exhaust gas composition is the best measure of nitriding potential and can be used as a method of process control. We have used the delivery gas composition and rate of flow method for our trials because it is more easily measured and more accurately controlled.

The region of reduced nitrogen absorption near the top edge of the coil varies in the size of the region and the depth of the nitrogen deficit relative to the fully developed laminar region. The size of the region of diminished absorption and the depth of the nitrogen reduction seem to have been minimized by increasing the interwrap wire size and by increasing flow through the coil by minimizing leakage past the coil. Both these changes tend to increase the Reynolds number of the gas flow between the sheets. This suggests that more uniform properties are obtained when the inner circulation rate under the nitriding shelf conditions are increased and large interwrap gaps are employed.

Excess nitrogen above that required for coherent nitride formation is inevitably present when internally nitriding sheet. Excess nitrogen contributes very little to increasing the yield stress but can put some limitations on sheet performance. We have found that sheets that develop 70 to 80 ksi yield strength when fully nitrided and with total nitrogen held to less than 0.03 wt. % do not age in storage after temper rolling and redevelop yield points. Spot welding of this sheet, where the weld nugget is sandwiched between two sheets, can be done successfully with this material with high nitrogen levels of 0.07 wt. %. However, when an autongenous welding process involves creating a liquid metal pool exposed to air, gas evolution can be troublesome. We have found that total nitrogen levels of 0.04 wt. % or less produce welds with minimum gas evolution. Hardness values obtained in the weld metal and associated heat affected zone for a variety of weldment types were well behaved with neither high or low values obtained.

Figure 17A:
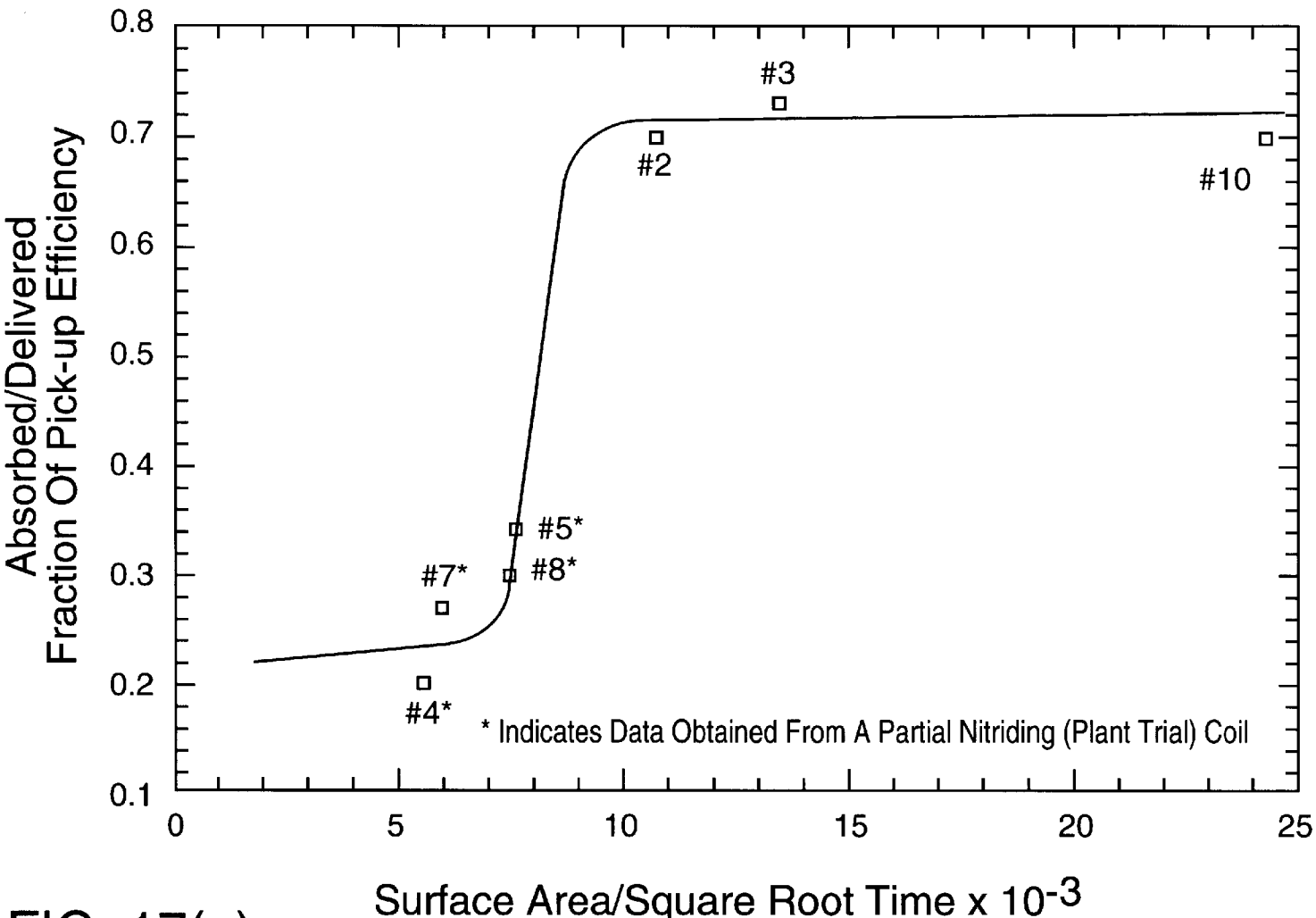
FIGS. 17(*a*) and 17(*b*) are graphs showing the efficiency of nitrogen absorption when coils were nitrided at 1050° F.
Figure 17B:
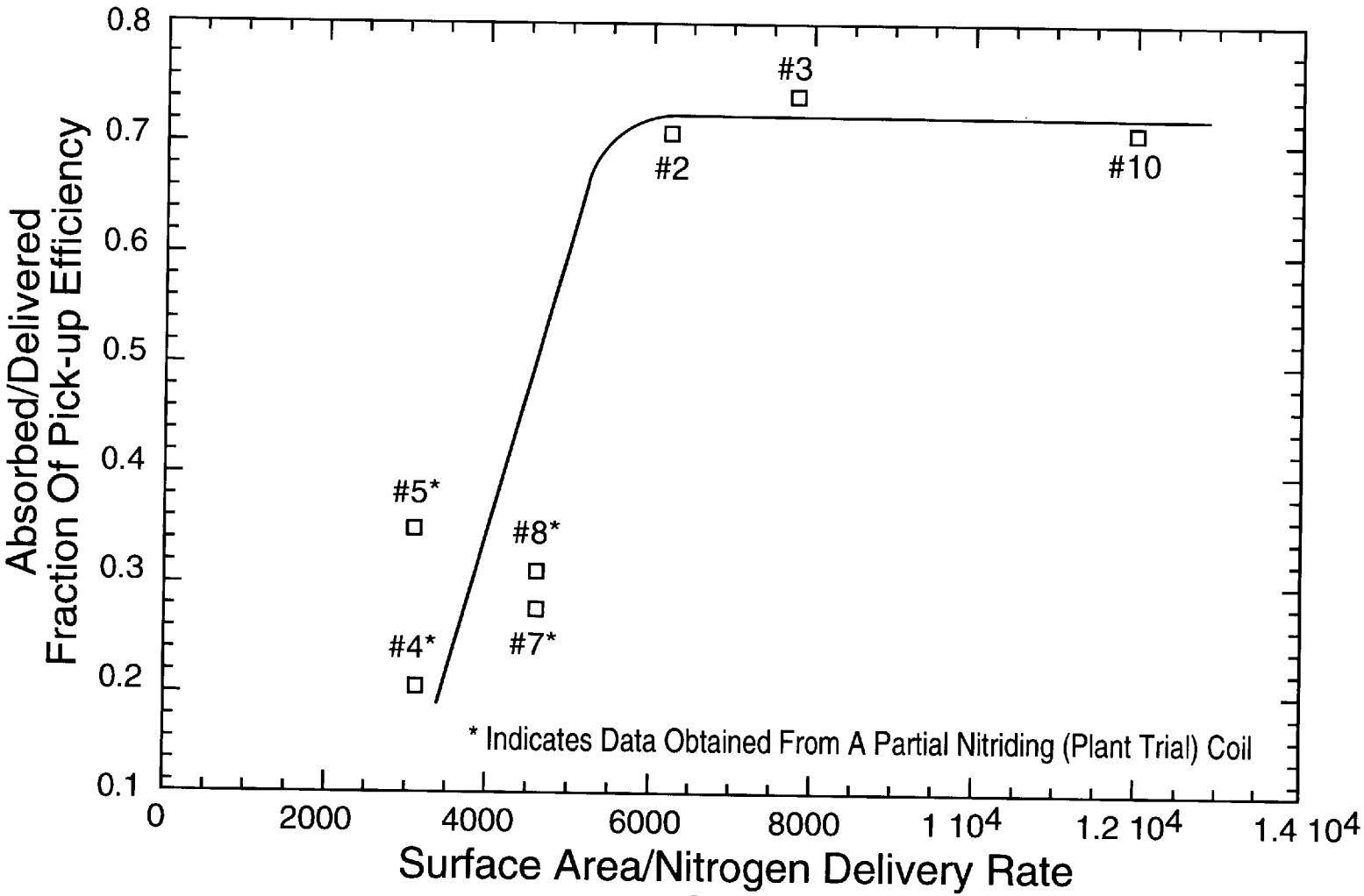

In order to hit an aim or target nitrogen level in sheet using this strengthening process it is necessary to control (a) total gas flow to the reactor (b) gas composition (c) nitriding time and (d) particularly, nitriding temperature. The absorption of nitrogen can be predicted by presenting the data collected from the trials in several ways. Obviously, one of the important parameters in determining the amount of nitrogen absorption is the total surface area of the sheet. In FIG. 17 the total absorbed nitrogen in the trials that employed partial or full nitriding at 1050° F. (but not excessive times beyond that required for full nitriding) is plotted against the reciprocal of the delivery rate of nitrogen (in the form of ammonia) per unit surface area. The absorbed nitrogen in FIG. 17(*a*) is divided by the square root of the nitriding time to normalize the trial to an equivalent nitriding depth. From this plot it can be seen that there is a roughly linear relationship between the normalized total absorption and the surface area per unit of delivered nitrogen. Trial 10 seems to fall well to the right of the line and the reason for this deviation from linearity is the large surface area of this coil. Depending on the ammonia concentration in contact with the sheet surface, there is a steady state value of the density of adsorbed nitrogen on the sheet surface that is largely determined by the rate of nitrogen absorption into the steel and the delivery rate per unit area to the sheet surface. If the delivery rate is insufficient to keep up with the diffusion controlled absorption, then the steady state concentration surface adsorbed nitrogen is reduced. In trial 10 this resulted in strength less than predicted by FIGS. 3(*a*)–(*c*) where normal steady state conditions for the gas mixtures and temperatures employed were used.

These results can be presented in a different way to illustrate the absorption process. This is illustrated in FIG. 17(*b*) where the absorbed nitrogen fraction is plotted against the same surface area per unit delivery of nitrogen. This plot shows that there is a maximum absorption efficiency of about 70%. A conclusion that can be drawn from this is that the optimum point of operation is at the onset of saturation where one obtains the benefits of high conversion rates and the developed strength levels are in the range predicted by FIG. 3. A larger set of data relating to coil weights, widths, thicknesses, nitriding temperatures, nitriding mixtures, delivery rates and sheet compositions would enhance development of commercial practices for making sheet by this invention.

The internal circulation rate of the nitriding gas within the furnace is many orders of magnitude larger than the delivery rate of the nitriding gas to the furnace, and must be sufficient to provide temperature uniformity within the coil and full laminar flow of the gas in the wraps of the coil. To obtain full laminar flow conditions with minimum transition zone, the gas short circuit paths must be minimized, the fan power and characteristic curve must be appropriate, and the area between the coil wraps (determined by the separating wire size, the sheet thickness and the coil length) must be appropriate for the system. Although all the commercial scale work described herein was done with a single coil in the open coil annealing furnace, more than one coil at a time could have been strengthened if the OCA fan and gas delivery system volume were increased. The pressure drop across the coil in these experiments is estimated to be less than 1 inch of water for a ten ton coil of 30 mil sheet on the base at the nitriding shelf temperature. This produced an internal circulation gas flow of a few thousand cfm at the nitriding temperature. The ideal OCA furnace would have a variable speed fan to obtain optimum gas flow conditions during heating, cooling and nitriding phases of the furnace cycle. The fan also should be reversible so that the top to bottom property differences observed easily can be minimized by appropriately timed reversals of the internal circulation. The pressure drop across the coil must be constant from inner to outer wrap for uniform sheet strength.

We have demonstrated that yield strength can be controlled by various methods including nitriding to full thickness with controlling strength through the use of different nitriding temperatures, partial nitriding and postnitriding aging treatments. The first and last methods above are the simplest to employ as the transverse mechanical property variations are minimized.

A preferred range of nitriding temperatures is about 950°–1150° F. for superior sheet properties, although a lower temperature, down to about 800° F., may be used if a longer nitriding time required is not objectionable. Higher temperatures, up to about 1250° F. can be used to speed up the nitriding process for thicker sheet. In the latter case, care must be used to assure that iron nitride, $Fe_4N$, is not produced in the sheet on cooling after nitriding and unacceptably lower uniformity of properties developed. The high r value of the base sheet, e.g. about 1.7 or more, as determined by the Modul R measurement, is unaltered when nitriding at even higher temperatures up to 1350° F. However, overaging and subsequent softening occurs quickly (see FIG. 4) at 1350° F., which precludes the use of tempertures this high for practical purposes.

The principles of the above-described invention may be applied to the production of nitrided sheet of the same DDQSK-FS type steel in a continuous annealing furnace. Except for very thin sheet, e.g. on the order of 0.010 inch thick or less, in such case, nitriding is limited to case hardening by nitriding only partially the thickness of the sheet. Continuous annealing furnaces normally are operated at higher temperatures, e.g. above 1500° F., and annealing is carried out over shorter periods of only a few minutes, than for batch annealing. At such high temperatures stengthening nitrides overage quickly and lose their strengthening effect; above the Fe-N eutectoid at 1097° F $Fe_4N$ forms readily on subsequent cooling if the nitrogen level rises during nitriding to push the steel into the alpha to gamma phase field, and the slope of the nitrogen absorption isotherm is very steep which makes uniform nitrogen absorption, and hence uniform properties, difficult to obtain. Furthermore, austenite formation lowers the r value of the steel and does not harden from nitride formation like ferrite. Nevertheless, by using a lower temperature for nitriding, e.g. about 1300° F. to 1500° F., especially about 1400° F. max., by applying the principles of Equations 2 and 3 above, by carrying out the nitriding for periods up to about 20 minutes, and, we have found, by using dilute ammonia concentrations, e.g. under about 3 vol. %, especially about 2 vol. %, the DDQSK-FS type sheet can be strengthened by nitriding in a continuous process.

Table 9 shows predicted depth of nitriding, using a nitriding gas consisting of 2% ammonia in a buffer gas such as nitrogen.

TABLE 9

Nitriding Depth, mils, vs. Temperature and Nitriding Gas Flow Conditions for 2% Ammonia

| Temp. Degrees F. | Full Laminar Flow, 4 min. | Full Laminar Flow, 20 min |
|---|---|---|
| 1500 | 4.7 | 10.6(1) |
| 1400 | 3.7 | 8.3 |
| 1300 | 2.9 | 67.4 |

(1)Considerable overaging of TiN precipitates occurs under these conditions.

Under such conditions, as in a continuous annealing furnace, where residence time of the sheet typically is only a few minutes, skin hardening only can be obtained. If the furnace can hold the sheet at such temperatures for longer times, e.g. up to about 20 minutes, it is possible that very thin gauge sheet, e.g. up to about 0.010 inch, can be fully nitrided.

Very large volumes of nitriding gas must be supplied in such case, e.g. 600 to 900 cfh for each ton of steel produced and, for obtention of uniform properties, fully developed laminar gas flow should be maintained on the sheet surface. Efficient use of ammonia would require that some form of gas recirculation be used in this process.

The DDQSK-FS type steels produced in accordance with this invention are useful in applications where high strength and formability, with resistance to thinning and high work hardening coefficient, are needed, for example in the fabrication of automobile body parts, appliances, and the like. Very high strength sheet can be controlled in strength by chemistry alone, as shown in FIG. 16 illustrating strength response to incremental chemistry change in 30 mil sheet.

Steels made according to this invention offer many advantages to the steel mill operators. The steelmaking, hot rolling and cold rolling of these steels are processed identically which greatly simplifies plant operations. Since mechanical properties are developed in the last annealing/nitriding stage, order to delivery times can be shortened if the sheet can be made from hot band inventory by using partial nitriding to meet strength levels specified in an order.

The principles of this invention also can be applied to the strengthening, by nitriding, of parts and other articles formed from the DDQSK-FS or interstitial free steels contemplated by the invention. We use the terms "formed" or "forming" in a broad sense to include shaping, bending, drawing, roll-forming, and other conventional operations for making parts and articles from steel sheet. Where a steel sheet having a strong (111) texture is used, the sheet may be formed into an article of complex shape.

Sheet from which an article is to be formed may be produced by hot rolling, or by hot rolling followed by cold rolling, as above described, and annealed and formed, or formed and then annealed, as above described, and then nitrided, essentially as above described.

Tests have been made to determine if stored internal stresses produced when forming parts would cause substantial shape change when heating the part for nitriding. Our tests indicate that, for the DDQSK-FS type base sheet employed in this invention, the shape change due to stored residual stresses is very small. We find that shape change from part creep before nitriding is the most likely cause of part distortion. Producing a thin hard skin by nitriding at a very low temperature resolves both causes of distortion.

Thus, in one embodiment of the process as applied to formed articles, nitriding of the formed article is done during heating of the article within a temperature range of from about 700°–800° F. to about 1150° F., and introducing the nitriding gas to form a hardened skin of thickness and strength which will provide substantial support to the formed article and eliminate sagging of the article upon heating. Preferably, in this embodiment, nitriding is commenced during heating of the article, then, when the article reaches a temperature within the latter range and heating continues to an isothermal shelf below the stress relief temperature (about 1150° F.) where nitriding is conducted for a time period to complete nitriding and commensurate strengthening to the extent desired, dependent on steel and nitriding gas compositions, and nitriding temperature, all as above described. Following nitriding, the article is cooled in an inert atmosphere, e.g. HNX gas, to about 250° F. Nitriding gas is recirculated at a rate and in a manner to provide uniform gas flow across the surfaces of the formed article with no jets or stagnation areas present. Ammonia must be delivered and exhausted from the internal circulation system to refresh the internal ammonia mixture and to maintain it at an appropriate level. Estimates of the Reynolds number describing the flow of gases across the surface of the formed article in the furnace should be made to determine if the flow is in the laminar region where the Reynolds number is greater than 1 and less than 1500, or in the turbulent range where the Reynolds number is greater than 2000. As in the case of manufacture of nitrided sheets, gas flow rates should be adjusted so that conditions on the article surface fall clearly in the fully laminar or in the fully turbulent range.

The use of Reynolds number to describe gas flow conditions is illustrative, especially in the case of nitriding of parts and other formed articles of complex shape, because calculation of this number is complicated as it depends on the article surface geometry, that of close surroundings, and the flow rate and viscosity of the nitriding gas mixture. However, when nitriding many formed articles of the same shape, fixtures may be used to support the formed articles and additionally to make uniform gas flow more readily obtainable. For example, stacking similar parts with separators will provide a constant gap between the parts, similar to sheets in an open coil annealing furnace, and the type of gas flow between the parts can be made uniform for parts whose shape is not too complex. For well-separated parts that are individually supported, a slow, well-diffused gas flow, free of jets, and appropriately directed at the parts, is preferable.

The process as applied to formed articles can be modified to produce such articles wherein the strength varies from area to area on the article. This involves putting patterns on the article surface of either (a) poisons for the catalytic decomposition of ammonia, (b) ammonia/nitrogern barrier layers, or (c) layers of materials that do not catalyze ammonia. When a formed article, so treated, is nitrided, strengthening will occur only in the areas where the article surface is clean, i.e. free of such patterns. The patterns may be applied when the sheet is flat or after forming. Some of these surface pattern layers may be adjusted in thickness or surface density such that the nitriding rate is slowed but not arrested entirely. Using such methodology, the enhanced article strength is created and placed only where it is required in the formed article. A further modification is to place the pattern on the steel sheet, nitride the sheet and then produce the formed article. Still another modification includes a two-stage process, with some nitriding preceding the pattern placement on the sheet, followed by more nitriding later. Other variations of multiple stage nitriding involving removal of the blocking layers and cleaning before further nitriding takes place can easily be conceived. The blocking patterns as above described may or may not be identical and in register on opposite side of the sheet or formed part.

Another development of this nitriding technology is the manufacture of structures by welding formed parts made from different DDQSK-FS type sheet of differing thicknesses and differing free strengthening element content. By proper selection of each part base stock, a load-bearing structure can be fully nitrided to produce a very high strength-to-weight construction where strength is placed only in areas where it is needed.

What is claimed is:

1. A method of providing a sheet of deep drawing quality special killed, fully stabilized type steel of uniform enhanced strength and good formability and weldability, comprising:

a) providing an essentially unalloyed interstitial free carbon steel melt having a carbon content from about 0.001 to about 0.01 weight percent;

b) adding to the steel melt a strengthening element selected from the group consisting of titanium, niobium and vanadium and mixtures thereof in total amount from about 0.01 to about 0.3 free atomic percent available strengthening element uncombined with other elements ;

c) casting and rolling the steel into a sheet according to a practice selected from the group consisting of (A) hot rolling and (B) hot rolling followed by cold rolling, wherein, when practice (A) is selected, the steel slab is hot rolled to a bar at a starting temperature between 2350° F. and 1750° F., followed by finish rolling, with a ferrite structure, starting toward the high end of a temperature range of about 1200°–1675° F. and finishing toward the low end of this temperature range, and coiling below about 1250° F., and wherein, when practice (B) is selected, hot rolling is carried out by a practice selected from the group consisting of (1) rolling the steel slab, with an austenite structure, in the temperature range of about 2350° F. to 1500° F., followed by coiling (2) rolling the steel slab, with a ferrite structure, in the temperature range from a starting temperature of about 1675° F. and finishing and coiling at a temperature above 1375° F., with coiling temperature not less than about 1350° F., and the hot rolling is followed by cold rolling of the thus hot-rolled sheet to a reduction in thickness of at least about 60%;

d) coiling the rolled sheet;

e) annealing the rolled sheet at a temperature in the range from about 1275° F. to about 1350° F. to optimize formation of a (111) grain structure of the steel;

f) treating the annealed sheet in an open coil annealing furnace in an isothermal step at a nitriding temperature from about 800° F. to about 1250° F. with a nitriding gas delivered to the annealing furnace and consisting of ammonia and a inert buffer gas in such a ratio that exhaust gas composition at an exit edge of the open coil is about 1 vol. % to about 11 vol. % ammonia to all other gases present in the exhaust mixture, and for a time from about ½ hour to about 12 hours depending on the sheet thickness and the desired depth of strengthening, to nitride the steel through at least a portion of the sheet thickness;

g) recirculating the nitriding gas through the furnace at a rate and in a manner to provide fully developed laminar gas flow across the width of the sheet, and substantially equal gas flow rates in coil interwrap spaces from inner to outer wraps;

h) controlling the strengthening of the steel sheet as a function of steel composition, the nitriding gas composition, nitriding time, nitriding temperature, thickness of the steel sheet and depth of strengthening desired to provide a steel sheet having an 0.2% off-set yield strength after temper rolling of at least about 45 ksi and an r value in excess of about 1.8 for the cold rolled sheet.

2. A method according to claim 1 wherein, when the steel consists essentially, by weight percent, of about:

carbon 0.001 to 0.01% manganese 0.15 to 0.50% silicon 0.005 to 0.03% aluminum 0.02 to 0.06% sulfur 0.002 to 0.015% nitrogen 0.001 to 0.01% oxygen 0.001 to 0.01% iron balance except for incidental steelmaking impurities, wherein the amounts of carbon, nitrogen and oxygen are present in the lower parts of their respective ranges being effective to enhance the controllability of the amount of free strengthening element available for formation of nitrides on nitriding, and the method further comprises degassing the steel to reduce carbon interstials, and then deoxidizing the steel.

3. A method according to claim 2, wherein, in step f) the nitriding gas consists of a mixture of about 3 vol. % to about 12 vol. % ammonia in a buffer gas using a gas delivery rate determined by the nitrogen absorption efficiency of the system as shown in FIGS. 17(*a*) and (*b*).

4. A method according to claim 1, wherein, when the hot rolling followed by cold rolling practice is selected, with hot rolling in austenite, the hot rolling temperature range is from about 2200° F. to about 1650° F.

5. A method according to claim 1, wherein the nitriding temperature is from about 1000° F. to about 1150° F.

6. A method according to claim 1, further comprising periodically reversing the nitriding gas flow direction to minimize transverse nonuniformity of sheet properties.

7. A method according to claim 1, wherein the strength of the fully nitrided steel sheet is controlled primarily according to the relationship $\sigma_y$=18.1 +K $F_{m½}$ where σY is the yield strength of the steel, $F_M$ is the atomic percent of strengthening element and K is a constant dependent on sheet thickness, nitriding gas composition and particularly nitriding temperature.

8. A method according to claim 7, wherein the sheet is nitrided to a depth less than the full thickness of the sheet and the strength of the sheet is further controlled according to the relationship $\sigma_P 2\beta T_s^{-1} (\sigma-\sigma_B) \sqrt{t_c}+\sigma_B$ where $\sigma_P$ is the yield strength of the partially nitrided sheet, σ is the fully nitrided maximum yield stress for sheet of thickness, $\sigma_B$ is the base sheet yield strength $t_C$=t−0.25 and t is the partial nitriding time, t is time, $T_S$ is thickness of the sheet, and β is a constant equal to the slope of a graph of internal nitriding depth versus the square root of time at a particular nitriding temperature.

9. A method according to claim 1, wherein the depth of hardening of the steel sheet is controlled by the rate of nitrogen diffusion through the steel, by the nitriding potential, and by the amount of free strengthening element in the steel, according to the formula:

$$\text{Depth of Nitriding} = \frac{[\text{alpha } C_N D_N t_c]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

10. A method according to claim 7, wherein the depth of hardening of the steel sheet is further controlled by the rate of nitrogen diffusion through the steel, by the nitriding potential, and by the amount of free strengthening element in the steel, according to the formula:

$$\text{Depth of Nitriding} = \frac{[\text{alpha } C_N D_N t_c]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

11. A method according to claim 8, wherein the depth of hardening of the steel sheet is controlled by the rate of nitrogen diffusion through the steel, by the nitriding potential, and by the amount of free strengthening element in the steel, according to the formula:

$$\text{Depth of Nitriding} = \frac{[\text{alpha } C_N D_N t_c]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

12. A method according to one of claims 1 to 11, wherein, near the end of the nitriding process, the ammonia level in the nitriding gas mixture introduced into the open coil annealing furnace is reduced to a range of about 3% to about 5% to decrease the level of excess soluble nitrogen in the nitrided steel.

13. A method according to one of claims 1 to 11, wherein the buffer gas is nitrogen.

14. A method according to one of claims 1 to 11, wherein the nitrided sheet is annealed in a mixture of an effective amount up to about 15 vol. % hydrogen in argon to reduce excess soluble nitrogen in the nitrided sheet.

15. A method according to claim 1, wherein step "f" comprises treating the annealed sheet in a continuous annealing furnace in an isothermal step at a temperature from about 1300° F. to about 1500° F. with a nitriding gas delivered to the annealing furnace and consisting of a mixture of about 1 vol. % to about 3 vol. % ammonia in a buffer gas, and for a time from about 20 seconds to about 20 minutes, to nitride the steel through at least a portion of the sheet thickness.

16. A method according to claim 15, wherein the maximum temperature in the isothermal nitriding step is about 1400° F.

17. A method according to claim 16, wherein the nitriding gas flow rate delivered to the furnace is at least about 600 cfh for each ton of steel produced.

18. A method according to one of claims 15 to 17, wherein the direction of flow of the nitriding gas periodically is reversed.

19. A method according to claim 1 further comprising including in the processing cycle after nitriding a treatment of the sheet in a second isothermal annealing shelf at a temperature higher than the nitriding temperature but less than 1300° F. to increase the strength of a fully nitrided sheet which exhibits less than an aim strength, and in which second annealing treatment the furnace atmosphere is selected from the group consisting of reducing to nitrogen, neutral and weakly nitriding.

20. A method of producing a formed steel article of enhanced strength and good formability, comprising producing a rolled steel sheet in accordance with steps (a)–(e) of claim 1, fabricating the annealed sheet into a formed article, treating the formed article in a furnace in an isothermal step at a nitriding temperature from about 800° F. to about 1250° F. with a nitriding gas delivered to the furnace and consisting of a mixture of about 3 vol. % to about 12 vol. % ammonia in an inert gas delivered at such a rate as to provide about 0.5 to 2 pounds of ammonia per ton of steel per hour, and for a time from about ½ hour to about 12 hours depending on the thickness of the sheet from which the article is formed and the desired depth of strengthening, to nitride the steel through at least a portion of the article thickness, and recirculating the nitriding gas through the furnace at a rate and in a manner to provide fully developed laminar or turbulent gas flow of constant rate across the surface of the formed article.

21. A method of producing a formed steel article of enhanced strength and good formability, comprising producing a rolled steel sheet in accordance with steps (a)–(d) of claim 1, fabricating the sheet into a formed article, annealing the formed article at a temperature in the range from about 1275° F. to about 1350° F., treating the formed and annealed article in a furnace in an isothermal step at a nitriding temperature from about 800° F. to about 1250° F. with a nitriding gas delivered to the furnace and consisting of a mixture of about 3 vol. % to about 12 vol. % ammonia in an inert gas delivered at such a rate as to provide about 0.5 to about 2 pounds of ammonia per ton of steel per hour, and for a time from about ½ hour to about 12 hours depending on the thickness of the sheet from which the article is formed and the desired depth of strengthening, to nitride the steel through at least a portion of the article thickness, and recirculating the nitriding gas through the furnace at a rate and in a manner to provide fully developed laminar or turbulent gas flow of constant rate across the surface of the formed article.

22. A method according to claim 20, wherein the strength of the fully nitrided steel article is controlled primarily according to the relationship $\sigma_y$=18.1+K $F_{m^{1/2}}$ where σY is the yield strength of the steel, $F_M$ is the atomic percent of strengthening element and K is a constant dependent on sheet thickness, nitriding gas composition and nitriding temperature.

23. A method according to claim 21, wherein the strength of the fully nitrided steel article is controlled primarily according to the relationship $\sigma_Y$=18.1+K $F_{m^{1/2}}$ where $\sigma_Y$ is the yield strength of the steel, $F_N$ is the atomic percent of strengthening element and K is a constant dependent on sheet thickness, nitriding gas composition and nitriding temperature.

24. A method according to claim 22, wherein the formed article is nitrided to a depth less than the full thickness of a sheet from which the article is formed and the strength of the formed article is further controlled according to the relationship $\sigma_P=2\beta T_S^{-1}(\sigma-\sigma_B)\sqrt{t}+\sigma_B$ where $\sigma_P$ is the yield strength of the partially nitrided article, σ is the fully nitrided maximum yield stress for a sheet of thickness, $\sigma_B$ is the base steel sheet yield strength $t_C$=t−0.25 and t is the partial nitriding time, t is partial nitriding time, $T_S$ is thickness of the article, and β is a constant equal to the slope of a graph of internal nitriding depth versus the square root of time at a particular nitriding temperature.

25. A method according to claim 23, wherein the formed article is nitrided to a depth less than the full thickness of a sheet from which the article is formed and the strength of the formed article is further controlled according to the relationship $\sigma_P=2\beta T_S^{-1}(\sigma-\sigma_B)\sqrt{t}+\sigma_B$ where $\sigma_P$ is the yield strength of the partially nitrided article, σ is the fully nitrided maximum yield stress for an article of thickness, $\sigma_B$ is the base steel sheet yield strength $t_C$=t−0.25 and t is the partial nitriding time, t is partial nitriding time, $T_S$ is thickness of the article, and β is a constant equal to the slope of a graph of internal nitriding depth versus the square root of time at a particular nitriding temperature.

26. A method according to claim 24, wherein the depth of hardening of the formed article is controlled by the rate of nitrogen diffusion through the steel sheet from which the article is formed, by the nitriding potential, and by the amount of free strengthening element in the steel, according to the formula:

$$\text{Depth of Nitriding} = \frac{[\text{alpha } C_N D_N t]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

27. A method according to claim 25, wherein the depth of hardening of the formed article is controlled by the rate of nitrogen diffusion through the steel sheet from which the article is formed, by the nitriding potential, and by the amount of free strengthening element in the steel, according to the formula:

$$\text{Depth of Nitriding} = \frac{[\text{alpha } C_N D_N t]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

28. A method according to one of claims 20 and 27, further comprising placing on the formed article a pattern of a nitriding blocking material preventing nitriding on exposure of the article to a nitriding gas and, on nitriding, thereby producing on the formed article a pattern of enhanced strength due to nitriding of article areas not covered by the blocking material.

29. A method according to one of claims 20 and 27, further comprising placing on the steel sheet from which a formed article is to be fabricated a pattern of a nitriding blocking material preventing nitriding on exposure of the patterned steel surface to a nitriding gas, forming the sheet into a formed article, and, on nitriding, thereby producing on the formed article a pattern of enhanced strength due to nitriding of article areas not covered by the blocking material.

30. A method of enhancing the strength of a formable steel article, comprising:

a) providing a steel melt having composition consisting essentially of, by weight percent
carbon 0.001 to 0.01%
manganese 0.05 to 0.50%
silicon 0.005 to 0.08%
aluminum 0.02 to 0.06%
sulfur 0.002 to 0.02%
nitrogen 0.001 to 0.01%
oxygen 0.0005 to 0.01%
iron balance except for incidental steelmaking impurities, b) adding to the steel melt a strengthening element selected from the group consisting of titanium, niobium and vanadium and mixtures thereof in total amount from about 0.01 to about 0.3 free atomic percent available strengthening element uncombined with other elements, and the amounts of carbon, nitrogen and oxygen when present in the lower parts of their respective ranges being effective to enhance the controllability of the amount of free strengthening element available for formation of nitrides on nitriding;

c) processing the steel melt to an article form, d) treating the article in a furnace in an isothermal step at a nitriding temperature from about 800° F. to about 1250° F. with a nitriding gas delivered to the furnace and consisting of a mixture of about 3 vol. % to about 12 vol. % ammonia in an inert gas delivered at such a rate as to provide about 0.5 to about 2 pounds of ammonia per ton steel per hour, and for a time from about ½ hour to about 12 hours depending on the steel thickness and the desired depth of strengthening, to nitride the steel through at least a portion of the steel thickness;

e) recirculating the nitriding gas through the furnace at a rate and in a manner to provide fully developed laminar or turbulent gas flow at constant rate across the article, and f) controlling the strengthening of the article primarily according to the relationship $\sigma_y$=18.1+K $F_{m½}$ where $\sigma_Y$ is the yield strength of the steel, $F_N$ is the atomic percent of strengthening element and K is a constant dependent on article thickness, nitriding gas composition and particularly nitriding temperature.

31. A method according to claim 30, wherein the article is nitrided to a depth less than the full thickness of the article and the strength of the article is further controlled according to the relationship $\sigma_P=2\beta T_S^{-1}(\sigma-\sigma_B)\sqrt{t}+\sigma_B$ where $\sigma_P$ is the yield strength of the partially nitrided article, σ is the fully nitrided maximum yield stress for an article of thickness such that t is the full nitriding time required for the nitriding temperature employed, $\sigma_B$ is the base steel yield strength, t is partial nitriding time, $T_S$ is thickness of the article, and β is a constant equal to the slope of a graph of internal nitriding depth versus the square root of time at a particular nitriding temperature.

32. A method according to claim 31, wherein the depth of hardening of the steel article is controlled by the rate of nitrogen diffusion through the steel, by the nitriding potential, and by the amount of free strengthening element in the steel, according to the formula:

$$\text{Depth of Nitriding} = \frac{[\text{alpha } C_N D_N t_c]^{1/2}}{[F_M]^{1/2}} = \beta\sqrt{t_c}$$

where:

alpha is a constant near unity;

$C_N$ is the concentration of nitrogen absorbed on the surface of the steel;

$F_M$ is the atomic concentration of free strengthening element in the steel;

$D_N$ is the diffusion coefficient of nitrogen, and $t_C$=t−0.25 where t is the time of nitriding in hours;

β is a constant equal to the slope of a graph relating nitriding depth and the square root of time at a particular nitriding temperature.

33. A method according to one of claims 30 to 32, wherein processing of the steel melt to article form includes the steps of:

a) a rolling practice selected from the group consisting of (A) hot rolling a slab to sheet form and (B) hot rolling to sheet form followed by cold rolling the hot rolled sheet, wherein, when practice (A) is selected, the steel slab is hot rolled at a temperature between 2350° F. and 1750° F., followed by finish rolling, with a ferrite structure, toward the high end of a temperature range of about 1200°–1675° F. and finishing toward the low end of this temperature range, and coiling the sheet below about 1250° F., and wherein, when practice (B) is selected, hot rolling is carried out by a practice selected from the group consisting of (i) rolling the steel slab, with an austenite structure, in the temperature range of about 2350° F. to 1500° F., and (ii) rolling the steel slab, with a ferrite structure, in the temperature range from a starting temperature of about 1675° F. and finishing and coiling at a temperature above 1375° F., with coiling temperature not less than about 1350° F., and the hot rolling is followed by cold rolling of the thus hot-rolled sheet to a reduction in thickness of at least about 60%;

b) fabricating the rolled sheet into a formed article, and c) optionally, annealing the article at a temperature in the range from about 1275° F. to about 1350° F. to optimize formation of a (111) grain structure of the steel.

34. A method according to one of claims 30–32, wherein the rolled sheet is annealed before fabricating a formed article therefrom, and the thus-formed article is then nitrided.

35. A method according to one of claims 30–32 wherein the Reynolds number of the nitriding gas is controlled at a constant flow rate not to exceed about 1500.

36. A method according to one of claims 30–32 wherein the Reynolds number of the nitriding gas is controlled at a constant flow rate exceeding about 2000.

37. A method according to claim 35, wherein nitriding step (f) is carried out during heating of the article within a temperature range of from about 800° F. to about 1150° F. to form a hardened skin of thickness and strength providing substantial support to the formed article eliminating sagging of the article upon heating, continuing heating of the article to an isothermal shelf below the stress relief temperature of about 1150° F., and conducting nitriding at such isothermal shelf for a time sufficient to complete nitriding and commensurate strengthening of the article, and wherein the strength of the nitrided article is somewhat higher than that predicted by performance of step (f) of claim 35.

38. A fabricated structure comprising a plurality of welded formed parts of steel sheet, wherein different parts of the structure requiring different strengths are made from DDQSK-FS type nitrided steel sheets having different strengths and produced according to one of claims 30 to 32.

39. A steel sheet made according to one of claims 1–11 and 15–17, wherein the sheet is substantially free of iron nitrides and the mechanical properties of the sheet are substantially uniform along transverse and longitudinal dimensions of the sheet.

40. A steel sheet made according to one of claims 1–11 and 15–17, wherein the strength, hardness, r-value, n-value and total elongation are substantially constant along transverse and longitudinal dimensions of the sheet, and the steel sheet is free of substantial amounts of excess nitrogen significantly affecting weldability and resistance to aging on storage after temper rolling.

41. A steel sheet made according to one of claims 1–11 and 15–17, wherein the sheet has been nitrided to substantially the full thickness of the sheet with a nitriding gas in substantially full laminar flow over the surface of the sheet, the mechanical properties of the sheet are substantially constant along the transverse and longitudinal dimensions of the sheet, and the steel sheet is free of substantial amounts of excess nitrogen significantly affecting weldability and resistance to aging on storage after temper rolling.

42. A steel sheet made according to one of claims 1–11 and 15–17, wherein the sheet has been partially nitrided to a depth less than one half the full sheet thickness with a nitriding gas in substantially full laminar flow across the surface of the sheet to be nitrided, and the strength, hardness, r-value, n-value and total elongation of the sheet are substantially constant along the transverse and longitudinal dimensions of the sheet, and the steel sheet is free of substantial amounts of excess nitrogen significantly affecting weldability and resistance to aging on storage after temper rolling.

43. An article fabricated from a steel sheet made according to one of claims 1–11 and 15–17, wherein the steel sheet is substantially free of iron nitrides and the mechanical properties of the sheet are substantially uniform along transverse and longitudinal dimensions of the sheet.

44. A welded article fabricated from a steel sheet made according to one of claims 1–11 and 15–17, wherein the strength, hardness, r-value, n-value and total elongation of the sheet are substantially constant along the transverse and longitudinal dimensions of the sheet, and the steel sheet is free of substantial amounts of excess nitrogen significantly affecting weldability and resistance to aging on storage after temper rolling.

45. A welded article fabricated from a steel sheet made according to one of claims 1–11 and 15–17, wherein the sheet has been nitrided to substantially the full thickness of the sheet with a nitriding gas in substantially full laminar flow over the surface of the sheet, the strength, hardness, r-value, n-value and total elongation of the sheet are substantially constant along the transverse and longitudinal dimensions of the sheet, and the steel sheet is free of substantial amounts of excess nitrogen significantly affecting weldability and resistance to aging on storage of the sheet after temper rolling.

46. A welded article fabricated from a steel sheet made according to one of claims 1–11 and 15–17, wherein the sheet has been partially nitrided to a depth less than one half the full sheet thickness, the strength, hardness, r-value, n-value and total elongation of the sheet are substantially constant along the width of the sheet, and the steel sheet is free of substantial amounts of excess nitrogen significantly affecting weldability and resistance to aging on storage of the sheet after temper rolling.

47. A welded article fabricated from a steel sheet made according to one of claims 1–11 and 15–17, wherein the strength, hardness, r-value, n-value and total elongation of the sheet are substantially constant along the width of the sheet, and the steel sheet has a total nitrogen content not more than about 0.04 weight percent and exhibits good weldability and resistance to aging on storage after temper rolling.

48. A steel sheet made according to one of claims 22 and 23, wherein the mechanical properties of the sheet are substantially uniform along transverse and longitudinal dimensions of the sheet, and the steel sheet is free of substantial amounts of excess nitrogen significantly affecting weldability and resistance to aging on storage after temper rolling.

49. A steel sheet made according to one of claims 20–27, wherein the sheet has been nitrided with a nitriding gas in substantially full laminar flow over the surface of the sheet to be nitrided, wherein the strength, hardness, r-value, n-value and total elongation are substantially constant along the transverse and longitudinal dimensions of the sheet, and the steel sheet is free of substantial amounts of excess nitrogen significantly affecting weldability and resistance to aging on storage after temper rolling.

50. A steel sheet made according to one of claims 20–27 wherein the sheet has been nitrided with a nitriding gas in substantially full laminar flow over the surface of the sheet to be nitrided, the mechanical properties of the sheet are substantially constant along the transverse and longitudinal dimensions of the sheet, the maximum total nitrogen content of the steel is about 0.04 weight percent, and the steel sheet exhibits good weldability and resistance to aging on storage after temper rolling.

51. A welded article fabricated from a steel sheet according to one of claims 20–27, wherein the steel sheet has been nitrided with a nitriding gas in substantially full laminar flow over the surface of the steel to be nitrided, the strength, hardness, r-value, n-value and total elongation of the sheet are substantially constant along the transverse and longitudinal dimensions of the sheet, and the steel sheet is free of substantial amounts of excess nitrogen significantly affecting weldability and resistance to aging on storage after temper rolling.

* * * * *